US010065712B2

(12) United States Patent
Hallai et al.

(10) Patent No.: US 10,065,712 B2
(45) Date of Patent: Sep. 4, 2018

(54) FLOATING MODULAR PROTECTIVE HARBOR STRUCTURE AND METHOD OF SEASONAL SERVICE EXTENSION OF OFFSHORE VESSELS IN ICE-PRONE ENVIRONMENTS

(71) Applicants: Julian de Freitas Hallai, Spring, TX (US); Neven Krstulović-Opara, The Woodlands, TX (US)

(72) Inventors: Julian de Freitas Hallai, Spring, TX (US); Neven Krstulović-Opara, The Woodlands, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

(21) Appl. No.: 15/724,527

(22) Filed: Oct. 4, 2017

(65) Prior Publication Data

US 2018/0170487 A1 Jun. 21, 2018

Related U.S. Application Data

(60) Provisional application No. 62/437,315, filed on Dec. 21, 2016.

(51) Int. Cl.
*B63B 35/08* (2006.01)
*E02B 1/00* (2006.01)
(Continued)

(52) U.S. Cl.
CPC ..... *B63B 35/08* (2013.01); *B63B 59/00* (2013.01); *E02B 1/00* (2013.01); *B63B 2211/06* (2013.01); *E02B 17/0021* (2013.01)

(58) Field of Classification Search
CPC combination set(s) only.
See application file for complete search history.

(56) References Cited

U.S. PATENT DOCUMENTS 559,116 A * 4/1896 Baldwin ..... E02D 19/04 14/75
4,069,642 A 1/1978 Hendriks
(Continued)

FOREIGN PATENT DOCUMENTS

CN 102296565 A 12/2011
CN 103786841 A 5/2014
(Continued)

*Primary Examiner* — Kyle Armstrong
(74) *Attorney, Agent, or Firm* — ExxonMobil Upstream Research Company-Law Department

(57) ABSTRACT

Modular structure for protecting an offshore vessel in a body of water from forces of ice features in the body of water is described. The modular protective structure comprising a protective harbor wall constructed and arranged to enclose a harbor space and to counteract the forces of ice features in the body of water. The modular protective structure also comprising a flotation support supporting the protective harbor wall. The flotation support having a capacity to position the modular protective structure at a raised position where the flotation support maintains at least a portion of the protective harbor wall above the water surface such that a harbor is established and the offshore vessel is protected from the forces of ice features in the body of water. Methods which utilize such a modular protective harbor structure are also described.

14 Claims, 20 Drawing Sheets

(51) Int. Cl.
*B63B 59/00* (2006.01)
*E02B 17/00* (2006.01)

(56) References Cited

U.S. PATENT DOCUMENTS

| | | | | |
|---|---|---|---|---|
| 4,155,323 | A | 5/1979 | Finsterwalder | |
| 4,486,125 | A | 12/1984 | Reusswig | |
| 4,504,172 | A | 3/1985 | Clinton et al. | |
| 4,963,058 | A * | 10/1990 | Broughton | E02B 17/0017 405/14 |
| 4,984,935 | A | 1/1991 | de Oliveira Filho et al. | |
| 5,088,858 | A * | 2/1992 | Massoudi | E02B 17/0021 405/196 |
| 5,292,207 | A | 3/1994 | Scott | |
| 6,244,785 | B1 * | 6/2001 | Richter | B63B 3/04 114/125 |
| 6,276,876 | B1 | 8/2001 | Bone et al. | |
| 6,340,272 | B1 | 1/2002 | Runge et al. | |
| 8,641,327 | B2 | 2/2014 | Krehbiel et al. | |
| 8,684,630 | B2 | 4/2014 | Mahmoud | |
| 2008/0260468 | A1 | 10/2008 | Heskin et al. | |
| 2011/0158750 | A1 | 6/2011 | Reichel et al. | |
| 2015/0060137 | A1 | 3/2015 | Deul et al. | |

FOREIGN PATENT DOCUMENTS

| | | | |
|---|---|---|---|
| WO | WO 95/19472 | A1 | 7/1995 |
| WO | WO 2010/024685 | A1 | 3/2010 |
| WO | WO 2013/044978 | A1 | 4/2013 |

* cited by examiner

FLOATING MODULAR PROTECTIVE HARBOR STRUCTURE AND METHOD OF SEASONAL SERVICE EXTENSION OF OFFSHORE VESSELS IN ICE-PRONE ENVIRONMENTS

CROSS REFERENCE TO RELATED APPLICATION

This application claims the benefit of U.S. Provisional Application Ser. No. 62/437,315, filed Dec. 21, 2016, entitled "Floating Modular Protective Harbor Structure and Method of Seasonal Service Extension of Offshore Vessels in Ice-Prone Environments," the disclosure of which is incorporated herein by reference in its entirety.

FIELD

The present disclosure relates generally to methods and structures for protecting offshore vessels, and more particularly to methods and structures of protecting non-ice capable, offshore vessels from mobile ice and ice formations of Arctic, sub-Arctic, or other ice-prone offshore environments.

BACKGROUND

In recent years, exploration for and the production of hydrocarbons have extended operations to Arctic, sub-Arctic, and other ice-prone offshore environments where large bodies of moving ice are found. These large moving bodies of ice can severely damage offshore exploration, development, or production vessels, such as mobile offshore drilling units ("MODU"), platform vessels, or jackups.

An example of such an area is off the north coast of Alaska in the Beaufort Sea. With the onset of winter, the sea water near the coastline begins to freeze over. The freeze over results in the formation of a relatively smooth and continuous sheet of ice called "fast ice" which extends seaward from the shore to points which lie over water approximately 60 feet deep. The name fast ice implies that this sheet of ice is held fast to the land and does not move. Fast ice can, however, be moved by natural forces, such as currents, tides, and temperature changes, with the rate of movement being generally dependent on the thickness of the ice.

When set in motion, fast ice poses a threat to offshore operations. When the ice comes into direct contact with an offshore drilling structure, such as a production platform, large forces can develop. These forces cause the ice sheet to break and pile up directly against the offshore structure, forming a rubble field. As the rubble field grows and continues to be pressed against the structure, the forces can increase until the structure is seriously damaged.

Although it is subject to movement, fast ice is relatively stable during the winter. However, the fast ice sheet breaks up during the summer, resulting in the formation of many individual floating bodies of ice which are free to move about under the influence of winds and currents. These moving bodies of ice pose another threat to offshore operations.

Seaward of the fast ice zone is pack ice. Unlike fast ice, pack ice is discontinuous, rugged, and highly mobile. As pack ice moves, local areas of tension and compression develop, causing the ice to break and pile up. As a result, open leads and pressure ridges are formed.

Pressure ridges form in areas of pack ice which experience large compressive threes. The ice breaks and piles up, concentrating large masses of ice into relatively small areas. Pressure ridges extend well above and below the surrounding ice, and some are so large that they are able to survive the summer and become multi-year ice features.

During the winter season, many pressure ridges are embedded in the pack ice and move along with it, threatening any structure in their path. During the summer, pressure ridges can be blown toward shore, where they threaten structures and vessels which lie in shallow waters.

Heretofore, strategies for Arctic exploration, development, and production have included the construction of new-build, ice capable vessels and the reinforcement of existing vessels to make them ice capable. However, these approaches may impose prohibitively high costs and/or prohibitively long timelines that are inconsistent with the desire for quick deployment in Arctic exploration, development, or production operations during times of favorable business environments.

SUMMARY

The disclosure herein provides an alternative to the aforementioned strategies to use a non-ice capable vessel in combination with an ice-protective floating "harbor," which avoids a need for vessel strengthening and also accommodates use of any widely available non-ice capable vessels by separating the ice-resistance function from the exploration, development, and/or production activities of the vessel.

In an embodiment, the vessel would be operated as in environments that are not ice-prone, and the floating modular protective structure is used to create a protective harbor space. The floating modular protective structures may include modular protective walls constructed from simple, low-cost modular (precast concrete or metal) units positioned to create the protective "harbor" for non-ice capable exploration, drilling, or production vessels. The walls may be constructed by using either: modular concrete elements, such as blocks or panels, and/or modular metal elements, such as blocks or panels, that are mated together and operatively coupled together. Alternatively, the protective harbor wall may be a precast tank construction technology in combination with the flotation support. It is understood that embodiments described herein with respect to modular protective harbor walls may alternatively utilize a single, unitary protective harbor wall.

Similarly, the floating modular protective structures may include modular flotation supports. The modular flotation support may include a plurality of discrete flotation elements operatively coupled together to support the protective harbor wall. Alternatively, the flotation support may be a single, unitary structure instead of a modular construction. The unitary flotation support structure may be cast in place.

Presently, onshore tank sizes of up to 40 meters (m) in height and 80 m in diameter are constructed on shore, which are designed to resist extreme events, such as an impact from a commercial airplane.

In an embodiment, the present disclosure provides a modular protective structure including a protective harbor wall enclosure having sufficient strength to resist the ice loading that may accompany the end of the open water season in Arctic, sub-Arctic or other ice-prone environments. In an embodiment, the floating modular protective structure is moved to the location of a prospective offshore site for operations and is submerged in anticipation of a vessel float-in, whereupon, the protective harbor wall is raised and the vessel is moored within the harbor. When operations are completed the floating modular protective structure may be re-submerged to permit the vessel to be moved out and carried away by an ice capable heavy lift vessel. Alternatively or additionally, the protective harbor wall may include a gate to facilitate passage of a vessel into and out of the harbor. The modular protective structure may then be stowed or "winterized" by maintaining the modular protective structure in a submerged condition during a remainder of the ice season.

The present disclosure provides a modular structure for protecting an offshore vessel in a body of water from the forces of ice features in the body of water. The modular protective structure comprises a protective harbor wall and a flotation support. The protective harbor wall is constructed and arranged to enclose a harbor space. The harbor space is sized to receive the offshore vessel. The protective harbor wall is constructed and arranged to counteract the forces of ice features in the body of water. The flotation support supports the protective harbor wall and has the capacity to position the modular protective structure at a raised position where the flotation support is in a floating condition below a surface of the body of water and where the flotation support maintains at least a portion of the protective harbor wall above the surface of the body of water such that a harbor is established and the offshore vessel is protected by the protective harbor wall from the forces of ice features in the body of water.

In an embodiment, the flotation support is a modular flotation support comprising a plurality of discrete flotation elements operatively coupled together to form the modular flotation support. In an embodiment, the plurality of discrete flotation elements of the modular flotation support may comprise a plurality of discrete flotation elements (or caissons) operatively coupled together to form of an annulus.

In an embodiment, the protective harbor wall is a modular protective harbor wall comprising a plurality of discrete elements operatively coupled together to a form of the modular protective harbor wall which is open at the top and the bottom.

In an embodiment, the flotation support has a capacity to change net buoyancy of the modular protective structure between a first net buoyancy at the raised position of the modular protective structure and a second net buoyancy less than the first net buoyancy at a submerged position of the modular protective structure where the protective structure is sufficiently submerged to protect the modular protective structure from the forces of ice features in the body of water.

In an embodiment, the protective harbor wall may include a gate constructed and arranged to facilitate entry and exit of the offshore vessel and optionally other support vessels into and out of the established harbor. The gate may comprise a floating gate body and a hinged connection so that the gate body may be swung from a closed position outwardly to an open position. Alternatively, the gate may comprise a sliding partition, and the sliding partition may be operatively coupled to the protective harbor wall such that the wall may be moved to the side from a closed position to an open position to facilitate entry and exit of the offshore vessel into and out of the established harbor.

The modular protective structure may further comprise an anchorage (mooring) system constructed and arranged to retain the structure at a desired depth and/or location and the structure may have a capacity to be repeatedly moved to and used at a plurality of locations of operations. The protective harbor wall may also include a sloped outer wall portion in an orientation to break ice features by directing portions of the ice contacted by the sloped outer wall portion downwardly.

In an embodiment, the protective harbor wall may be a modular protective harbor wall including a plurality of discrete elements. The plurality of discrete elements of the modular protective harbor wall may comprise a plurality of discrete panels operatively coupled together to form a walled body (the modular protective harbor wall) which is open at the top and bottom (i.e., having an open upper portion and an open lower portion). The plurality of discrete panels of the modular protective harbor wall may comprise a plurality of precast concrete panels, the modular protective harbor wall further comprising a wire wrapping around the circumference of the precast concrete panels and a layer of shotcrete disposed over the wire wrapping. Alternatively or in addition, the plurality of discrete elements of the modular protective harbor wall may comprise a plurality of metallic panels. The modular protective harbor wall may be constructed and arranged to have a strength to withstand the anticipated ice conditions, such as moderate ice conditions or extreme ice conditions. In some embodiments, the modular protective harbor wall may provide the ability to extend operations to a year round capacity by protecting the vessel within the established harbor.

The form of the protective harbor wall may be any suitable geometry, such as circular, elliptical, rectangular, square, or other polygons in transverse (radial) cross-sectional view. The form of the flotation support may have a similar geometry as the protective harbor wall or a different geometry.

In an embodiment, an upper, outer edge portion of the annulus of the flotation support may support the protective harbor wall in an axisymmetrical relation. In another embodiment, a remaining upper portion of the annulus of the flotation support extends radially within the protective harbor wall and is constructed and arranged to receive end portions of extendible legs of a jackup as the offshore vessel.

Each discrete flotation element of a modular flotation support may comprise a hollow, walled body with closed end portions. The modular protective structure may further comprise an arrangement to adjust net buoyancy of the modular protective structure by adjusting the buoyancy of at least one of the discrete flotation elements by the introduction and removal of a ballast. In an embodiment, the modular flotation support may comprise a hollow, walled body with open end portions including a plurality of discrete elements forming a hollow annulus.

In an embodiment, the annulus of the flotation support is disposed around an outer periphery of the protective harbor wall, such that the established harbor is free of the flotation support. Alternatively, the protective harbor wall may be disposed around an outer periphery of the annulus of the flotation support such that the flotation support is at least partially enclosed by the protective harbor wall.

In an embodiment, the plurality of discrete flotation elements of the modular flotation support comprises a plurality of rectanguloid flotation bodies operatively coupled together to form a rectangular annulus. The modular protective harbor wall comprises walled portions of such rectanguloid bodies and an arrangement is provided to adjust net buoyancy of the modular protective structure by adjusting the buoyancy of the rectanguloid flotation bodies by the introduction and removal of a ballast.

The offshore vessel may be any suitable vessel used for offshore exploration, development or production activities, such as a drill ship, a MODU vessel, a floating production storage and offloading vessel, a floating liquefied natural gas vessel, a jackup, and/or any other floating service platforms. It is understood that any other support vessels, such as supply vessels, towing vessels, shipping vessels, and the like, may also be protected within the modular protective structure.

The plurality of discrete flotation elements of a modular flotation support may be operatively coupled with steel tendons of post tensioners. Likewise, discrete elements may be operatively coupled with steel tendons of post tensioners in a construction of the modular protective harbor wall.

The disclosure also provides a method for extending the service of a floating offshore vessel in a geographical region having a season of ice conditions. The method includes establishing a harbor space protected from forces of ice features in a body of water at a location of operations by supporting a protective harbor wall with a flotation support to form a modular protective structure. The protective harbor wall is constructed and arranged to enclose the harbor space. The harbor space is sized to receive the floating offshore vessel and the flotation support has a capacity to support the protective harbor wall in a raised position at the location of operations. The raised position including the flotation support in a floating condition below a surface of the body of water with at least a portion of the protective harbor wall extending above the surface of the body of water. The method also includes moving the offshore vessel into a position within the protective harbor wall at the location of operations and extending operations of the offshore vessel in the season of ice conditions. By maintaining the protective harbor wall in the raised position, the offshore vessel is protected from ice features during the extended operations.

In an embodiment, the moving of the offshore vessel may include moving the offshore vessel into or out the harbor by opening and closing a gate allowing ingress to and egress from the harbor through the protective harbor wall.

In an embodiment, the moving of the offshore vessel may comprise: submerging the modular protective structure at the location of operations; moving the offshore vessel into a position proximate the location of operations; and raising the modular protective structure around the offshore vessel using the flotation support such that the offshore vessel is protected from forces of ice features in the body of water by the raised protective harbor wall.

Moving the offshore vessel may include withdrawing the offshore vessel from the harbor by lowering the protective harbor wall by submerging the flotation support to a greater depth and moving the offshore vessel away from the location of operations. The method may further comprise returning an offshore vessel to the location of operations prior to a conclusion of the season of ice conditions with assistance of an ice capable vessel and repeating the moving, raising and extending.

The method may further comprise retaining the protective harbor wall and the flotation support at the location of operations with an anchorage system.

The method may further comprise stowing the modular protective structure in a submerged condition between or during operation seasons. The method also may comprise repeatedly moving the modular protective structure amongst a plurality of locations of operations and reusing the modular protective structure at the plurality of locations regardless of any differences in depth amongst the locations of operations.

The present disclosure also provides a method of preparing a site for operations in a region having periods of ice conditions. The method includes constructing a modular protective harbor wall by operatively coupling a plurality of panels together to form an annulus; constructing a modular flotation support by: constructing a plurality of discrete flotation elements, launching the constructed plurality of flotation elements into a body of water, and operatively coupling together the launched plurality of flotation elements to form an annulus; operatively coupling the modular protective harbor wall and the modular flotation support to create a submersible modular protective harbor structure; and moving the submersible modular protective harbor structure to the site of operations. The constructing the modular flotation support may further comprise adding an anchorage system constructed and arranged to retain the submersible protective harbor structure at a desired depth and/or location. The constructing the modular protective harbor wall may further comprise providing the modular protective harbor wall with a gate constructed and arranged to provide an offshore vessel ingress to or egress from the harbor created by the modular protective harbor structure.

The disclosure also provides a method of preparing a site for an operation in a region having periods of ice conditions. The method includes constructing a modular protective structure by operatively coupling a plurality of discrete rectanguloid blocks in a form having a central opening, wherein an upper section of the plurality of discrete rectanguloid blocks forms a modular protective harbor wall and a lower section of the plurality of discrete rectanguloid blocks forms a modular flotation support. The modular protective structure also includes an arrangement to adjust the net buoyancy of the modular protective structure by adjusting the buoyancy of at least some of the discrete rectanguloid blocks by the introduction and removal of a ballast within such discrete rectanguloid blocks. The modular protective structure has the capacity to move between a submerged position where the modular protective structure is floating and located below a surface of a body of water and a raised position where the modular protective structure has sufficient net buoyancy to maintain at least a portion of the modular protective harbor wall above the surface of the body of water. In the raised position, a harbor is established that is protected by the modular protective harbor wall from ice features in the body of water. The method may also include moving the modular protective structure from a remote location to the location of operations.

The disclosure also provides a method for producing an additional margin of hydrocarbons annually from a site operations having a season of ice conditions using a non-ice capable offshore vessel based upon the embodiments described herein.

BRIEF DESCRIPTION OF THE DRAWINGS

While the present disclosure is susceptible to various modifications and alternative forms, specific exemplary implementations thereof have been shown in the drawings and are herein described in detail. It should be understood, however, that the description herein of specific exemplary implementations is not intended to limit the disclosure to the particular forms disclosed herein. This disclosure is to cover all modifications and equivalents as defined by the appended claims. It should also be understood that the drawings are not necessarily to scale, emphasis instead being placed upon clearly illustrating principles of exemplary embodiments of the present disclosure. Moreover, certain dimensions may be exaggerated to help visually convey such principles. Further where considered appropriate, reference numerals may be repeated among the drawings to indicate corresponding or analogous elements. Moreover, two or more blocks or elements depicted as distinct or separate in the drawings may be combined into a single functional block or element.

Similarly, a single block or element illustrated in the drawings may be implemented as multiple steps or by multiple elements in cooperation.

DETAILED DESCRIPTION

Figure 1:
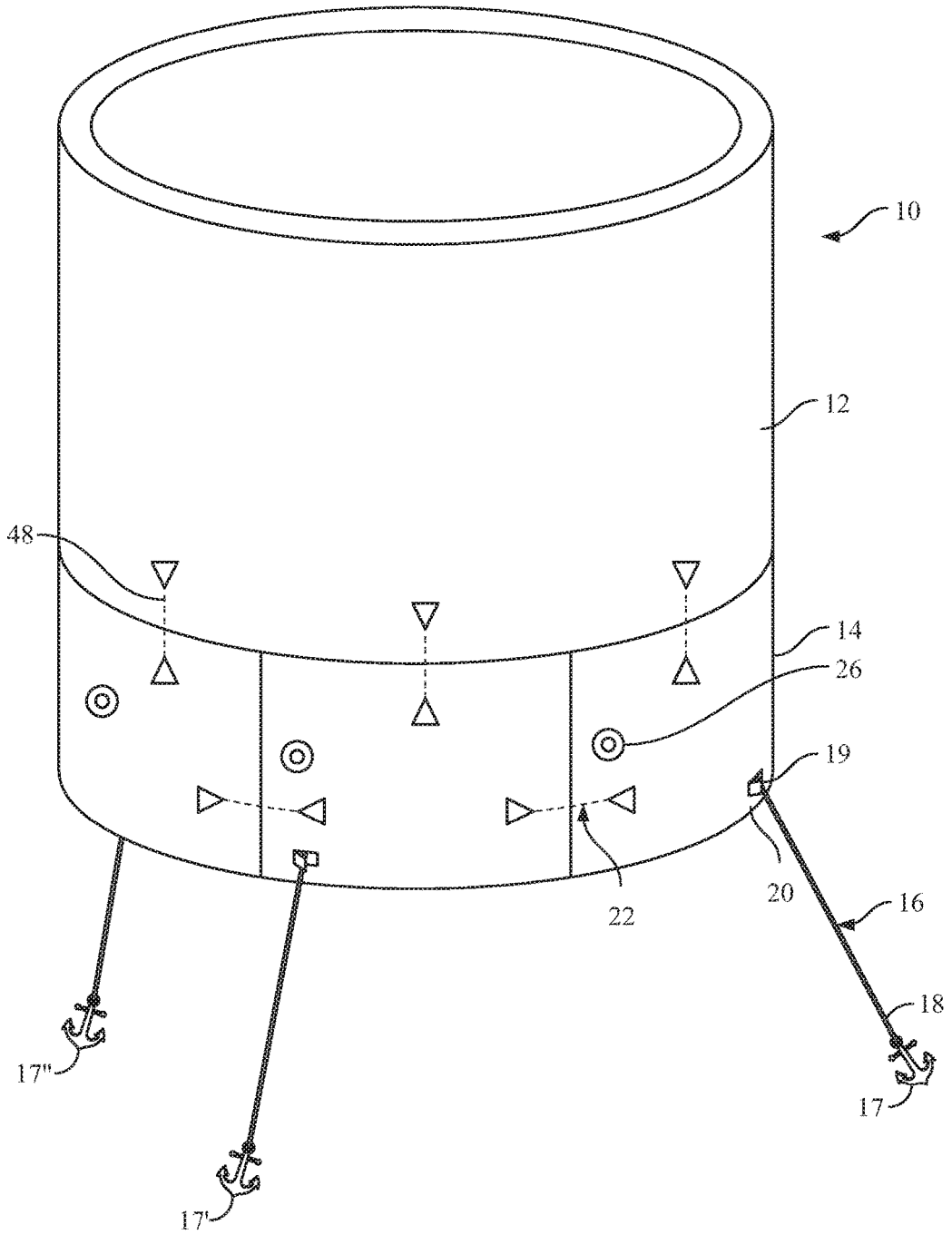
FIG. 1 is a perspective view of a floating modular protective harbor structure in accordance with an exemplary, axisymmetrical embodiment of the present disclosure.

The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than the broadest meaning understood by skilled artisans, such a special or clarifying definition will be expressly set forth in the specification in a definitional manner that provides the special or clarifying definition for the term or phrase.

For example, the following discussion contains a non-exhaustive list of definitions of several specific terms used in this disclosure (other terms may be defined or clarified in a definitional manner elsewhere herein). These definitions are intended to clarify the meanings of the terms used herein. It is believed that the terms are used in a manner consistent with their ordinary meaning, but the definitions are nonetheless specified here for clarity.

A/an: The articles "a" and "an" as used herein mean one or more when applied to any feature in embodiments and implementations of the present disclosure described in the specification and claims. The use of "a" and "an" does not limit the meaning to a single feature unless such a limit is specifically stated. The term "a" or "an" entity refers to one or more of that entity. As such, the terms "a" (or "an"), "one or more" and "at least one" can be used interchangeably herein.

And/or: The term "and/or" placed between a first entity and a second entity means one of (1) the first entity, (2) the second entity, and (3) the first entity and the second entity. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements). As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of".

Any: The adjective "any" means one, some, or all indiscriminately of whatever quantity.

At least: As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements). The phrases "at least one", "one or more", and "and/or" are open-ended expressions that are both conjunctive and disjunctive in operation. For example, each of the expressions "at least one of A, B and C", "at least one of A, B, or C", "one or more of A, B, and C", "one or more of A, B, or C" and "A, B, and/or C" means A alone, B alone, C alone, A and B together, A and C together, B and C together, or A, B and C together.

Comprising: In the claims, as well as in the specification, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

Couple: Any use of any form of the terms "connect", "engage", "couple", "attach", "join", or any other term describing an interaction between elements is not meant to limit the interaction to direct interaction between the elements and may also include indirect interaction between the elements described.

Embodiments: Reference throughout the specification to "one embodiment," "an embodiment," "some embodiments," "one aspect," "an aspect," "some aspects," "some implementations," "one implementation," "an implementation," or similar construction means that a particular component, feature, structure, method, or characteristic described in connection with the embodiment, aspect, or implementation may be combined with one or more other embodiments and/or implementations of the present disclosure. Thus, the appearance of the phrases "in one embodiment" or "in an embodiment" or "in some embodiments" (or "aspects" or "implementations") in various places throughout the specification are not necessarily all referring to the same embodiment and/or implementation. The particular features, structures, methods, or characteristics of one embodiment may be combined in any suitable manner with features, structures, methods, or characteristics of one or more other embodiments or implementations.

Exemplary: "Exemplary" is used exclusively herein to mean "serving as an example, instance, or illustration." Any embodiment described herein as "exemplary" is not necessarily to be construed as preferred or advantageous over other embodiments.

May: The word "may" is used throughout this application in a permissive sense (i.e., having the potential to, being able to), not a mandatory sense (i.e., must).

Operatively connected, attached, and/or coupled: Operatively connected, attached, and/or coupled means directly or indirectly connected features.

Order of method steps: It should also be understood that, unless clearly indicated to the contrary, in any methods described herein that include more than one step or act, the order of the steps or acts of the method is not necessarily limited to the order in which the steps or acts of the method are recited.

Ranges: Concentrations, dimensions, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of 1 to 200 should be interpreted to include not only the explicitly recited limits of 1 and 200, but also to include individual sizes such as 2, 3, 4, etc. and sub-ranges such as 10 to 50, 20 to 100, etc. Similarly, it should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

Reference will now be made to exemplary embodiments and implementations. Alterations and further modifications of the inventive features described herein and additional applications of the principles of the disclosure as described herein, such as would occur to one skilled in the relevant art having possession of this disclosure, are to be considered within the scope of the disclosure. Further, before particular embodiments of the present disclosure are disclosed and described, it is to be understood that this disclosure is not limited to the particular process and materials disclosed herein as such may vary to some degree. Moreover, in the event that a particular aspect or feature is described in connection with a particular embodiment, such aspects and features may be found and/or implemented with other embodiments of the present disclosure where appropriate. Specific language may be used herein to describe the exemplary embodiments and implementations. It will nevertheless be understood that such descriptions, which may be specific to one or more embodiments or implementations, are intended to be illustrative only and for the purpose of describing one or more exemplary embodiments. Accordingly, no limitation of the scope of the disclosure is thereby intended, as the scope of the present disclosure will be defined only by the appended claims and equivalents thereof.

Figure 2:
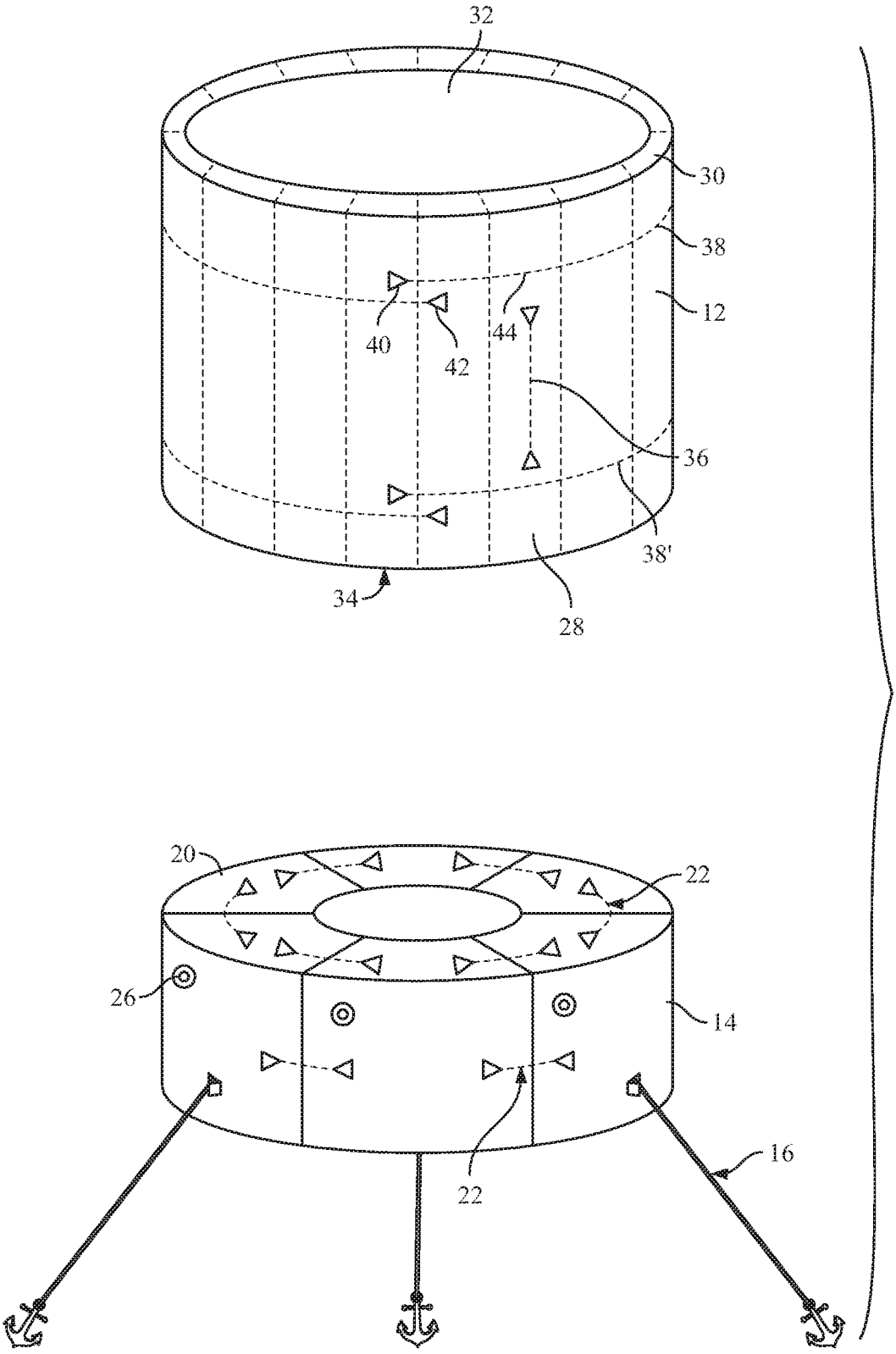
FIG. 2 is a perspective view of the modular protective harbor wall and the modular flotation support of the floating protective harbor structure of FIG. 1.

Referring now to FIGS. 1 and 2, the present disclosure provides a floating modular protective harbor structure 10 comprising a modular protective harbor wall 12 and a modular flotation support 14, which may be separately constructed and then combined together as shown in FIG. 1. The floating modular protective harbor structure 10 may include an anchorage (mooring) system 16 comprising components, such as an anchor 17, an anchor line 18 and a reel (winch) 19. The anchorage system 16 may comprise a plurality of anchors 17, 17', 17" and possibly more, in number and position around the modular flotation support 14 (or harbor wall 12) to maintain the floating modular protective harbor structure 10 at a desired depth and position at an offshore site of operations.

Figure 3A:
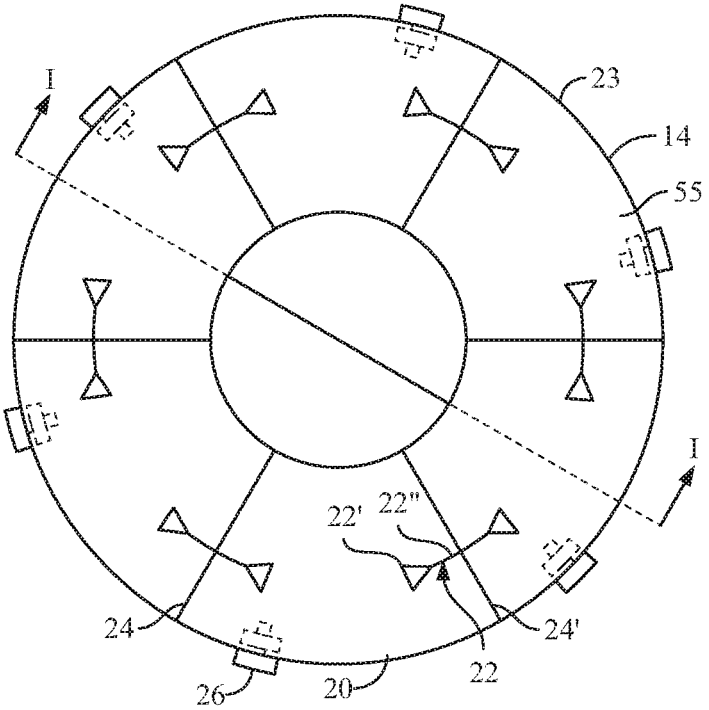
FIG. 3*a* is a top planar view of the modular flotation support of the floating protective harbor structure of FIG. 1.
Figure 3B:
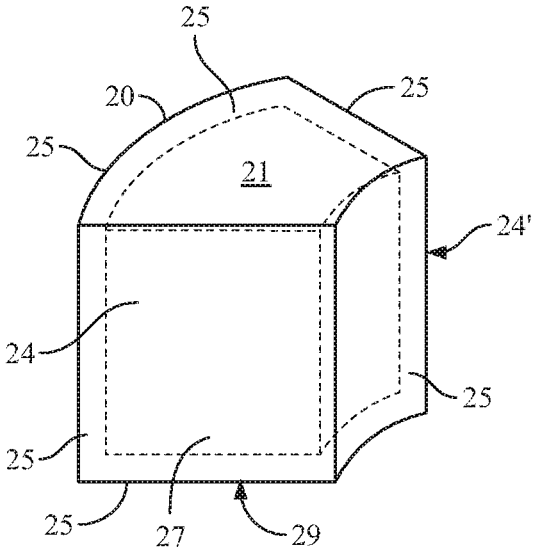
FIG. 3*b* is a perspective view of a discrete flotation element of the modular flotation support of FIG. 3*a*.

Referring now to FIGS. 2, 3*a* and 3*b*, in an embodiment, the modular flotation support 14 comprises a plurality of discrete, modular flotation elements 20 which are operatively coupled together at connectors 22 in an end to end relation to form an annulus 23. In the present embodiment, each flotation element 20 is generally arcuate and includes a hollow, walled structure having closed ends 24, 24' and a closed top 21 and bottom 29 such that the walls 25 of each modular flotation element 20 encloses an internal chamber 27 that serves as a ballast tank for the intake and removal (purging) of ballast, such as seawater, using an arrangement 26 including a ballast pump, a valve, and a conduit (not shown) to introduce or remove ballast from internal chamber 27. In the present embodiment, each modular flotation element 20 is provided with its own arrangement 26, but such may not be the case in other embodiments where only a selected few, but not all, of modular flotation elements 20 may be provided with an arrangement 26 or a selected few, but not all, of the arrangements 26 are operated at any given time. The mechanical components of each arrangement 26 are located within the confines of the respective modular flotation element 20 for protection against the environment.

In an embodiment, each modular flotation element 20 is constructed of concrete and the connectors 22 between the modular flotation elements 20 may comprise a plurality of (embedded) anchors 22' and tensioned tendons 22" of a plurality of post-cast tensioners, the number and placement of which may differ from those specifically depicted in FIGS. 2 and 3*a*. Alternatively, the connectors 22 may be other mechanical connectors, such as superposed, pinned brackets, hooks, and other forms of mechanical locks and connections. Alternatively, the connector 22 may comprise a winding of wires around the circumference of the annulus 23, together with a protective coating, such as layer of concrete (shotcrete), that may be applied over (disposed on) the wire wrapping as a protective layer against the corrosive effects of seawater.

The annulus 23 of the modular flotation support may be any suitable diameter. In certain constructions, the annulus 23 of the modular flotation support may have a diameter of approximately 50 to 100 meters. The walls of the flotation elements of the flotation support may be any suitable thickness. In certain constructions, the walls of the flotation elements may have thicknesses of approximately 0.5 m of concrete. In other certain constructions, the walls of the flotation elements may be constructed of metal panels having a suitable thickness to support the protective harbor wall. The protective harbor wall may be any suitable thickness to counter the forces of the ice features. In some embodiments, the thickness of the walls of the flotation elements may be the same thickness as the protective harbor wall. In other embodiments, the thickness of the walls of the flotation elements may be a lesser thickness than the protective harbor wall or a greater thickness than the protective harbor wall.

In yet another embodiment, the ends 24, 24' of the modular flotation elements 20 may be open, such that upon operatively coupling the modular flotation elements 20 together, the internal chamber 27 is defined by and extends throughout several or all of the modular flotation elements 20. In such embodiments, the seams formed between adjacent modular flotation elements 20 are sealed in any suitable manner to prevent the ballast fluid within the internal chamber 27 from entering the surrounding body of water and the surrounding body of water from entering the internal chamber 27.

Referring back to FIG. 2, the modular protective harbor wall 12 may comprise a plurality of elongate, vertically oriented elements or panels 28 operatively coupled together in a side-by-side relation to form a hollow body 30 having open end portions 32 and 34. In the present embodiment, the hollow body 30 has a cylindrical form; however, the hollow body 30 of modular protective harbor wall may be any suitable geometry. In the present embodiment, each panel 28 may be cast from concrete and may include a vertically oriented, post tensioner 36 embedded therein. The post tensioner 36 may include a plurality of (embedded) anchors and a tensioned tendon. In an embodiment, the panels 28 are operatively coupled together by a plurality of circumferentially directed post tensioners 38, 38' each comprising opposing anchors 40, 42 which maintain steel tendons 44 in tension. The steel tendons 44 may extend completely around the circumference of the hollow body 30 or a portion thereof. A series of post tensioners 38 may be disposed adjacent one another along the substantial longitudinal length of the modular protective harbor wall 12; however, only a pair of circumferentially directed post tensioners 38, 38' are shown in FIG. 2.

In an embodiment, the tensioners 36 of the panels 28 may be oriented other than vertical, and may include horizontal tensioners, and/or diagonal tensioners (tendons). It is also envisioned that the panels 28 may be constructed without prestressing or post tensioners and may be coupled to one another with pins, interlocking shear keys and other interlocking connectors with or without prestressing or post tensioners.

Likewise, the post tensioners 38, 38' circumferentially disposed around the modular protective harbor wall 12 may be oriented other than what is specifically shown in the exemplary embodiment (FIG. 2). Alternatively to the assembly of panels 28, the protective harbor wall 12 may be cast as a single unit, such as a cast in place wall, with or without prestressing or post tensioners. It is understood that a cast unitary protective harbor wall may be used alternatively to the modular protective harbor wall 12 described herein to form the floating modular protective structure 10.

Figure 9:
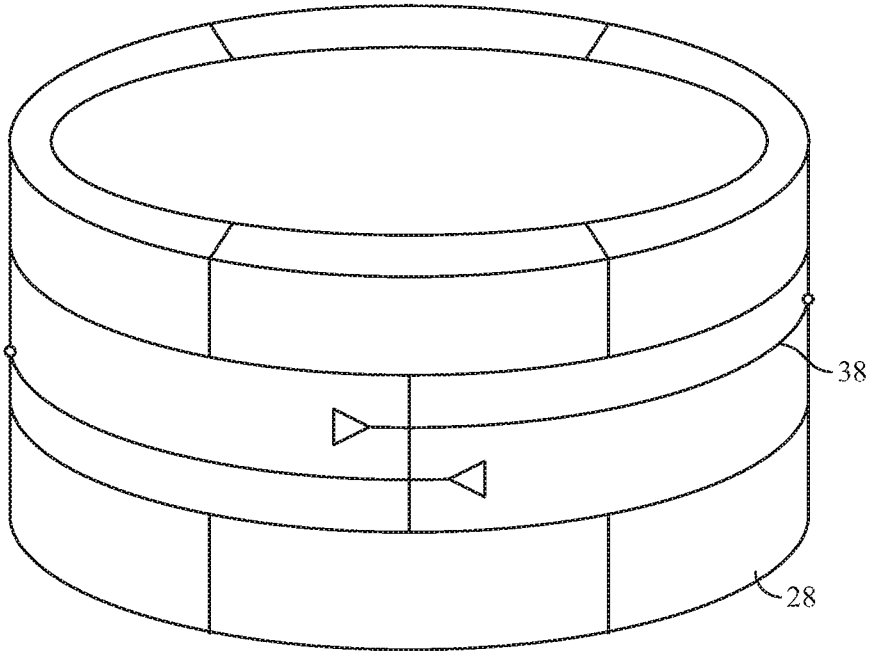
FIG. 9 is a perspective view of a modular protective harbor wall constructed in accordance with another embodiment of the present disclosure.

In another embodiment, the panels 28 may be arcuate and elongate in the circumferential direction, such as depicted in FIG. 9. Post tensioners 38 may be disposed circumferentially around the panels 28 to operatively couple the panels 28 together. In such embodiments, the panels 28 may be constructed of metal alternatively or in addition to concrete.

Referring now to the embodiment of FIGS. 1, 2, and 3*a*, once constructed, the modular protective harbor wall 12 may be operatively coupled to modular flotation support 14 in an axisymmetrical relation such that the modular protective harbor wall 12 is supported by the modular flotation support 14 at an upper, outer peripheral edge portion 55 of the modular flotation support 14. The modular protective harbor wall 12 and modular flotation support 14 may be secured to one another by connectors 48 that may comprise a series of post-cast tensioners or other mechanical connectors, such as bolts, brackets, and other various forms of mechanical connections. Suitable connectors may be adapted from those used in the construction of land based tank structures, such as those proposed in U.S. Pat. No. 4,069,642, which is incorporated herein by reference in its entirety.

Figure 4:
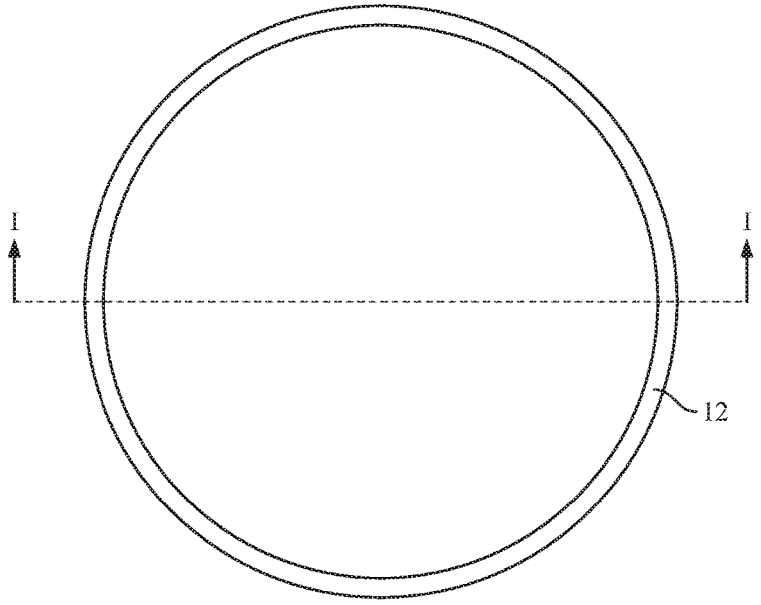
FIG. 4 is a top planar view of the modular protective harbor wall of the floating protective harbor structure of FIG. 1.
Figure 5A:
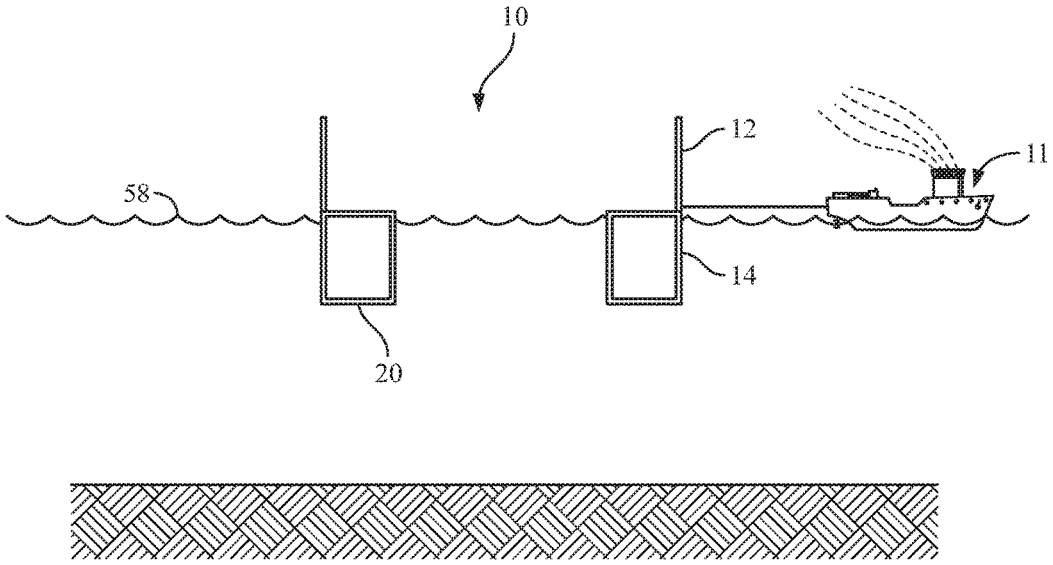
FIGS. 5*a-e* provide a representation of an exemplary deployment sequence of the modular floating protective harbor structure of FIG. 1 and a jackup at an offshore site of operations in an ice-prone offshore environment with the floating modular protective harbor structure being shown in cross-section taken from the perspective of the double arrow I-I in FIGS. 3*a* and 4.
Figure 5B:
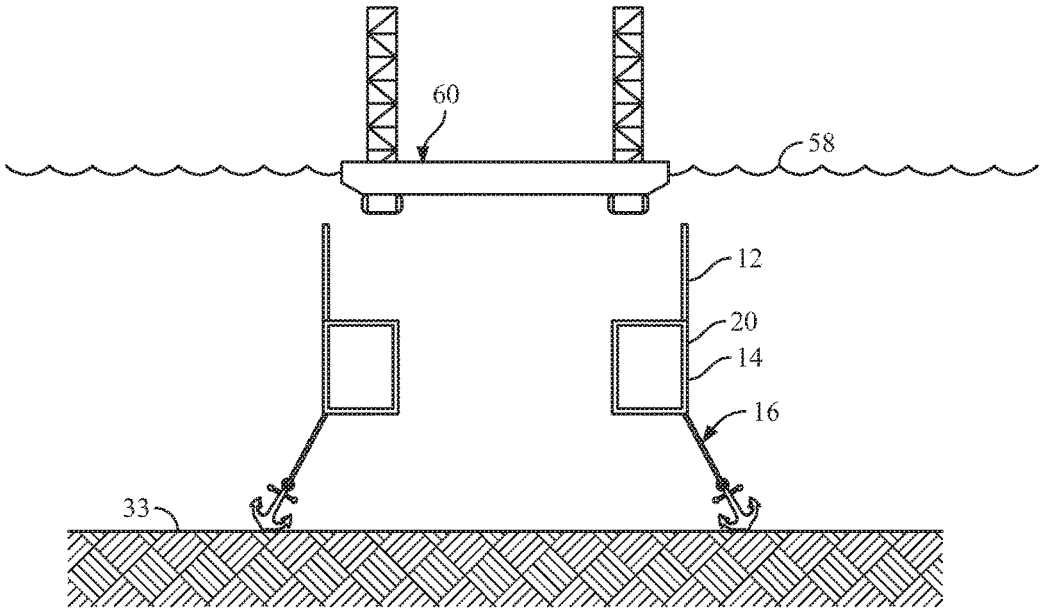

Referring now to FIGS. 5*a-e*, once constructed, the floating modular protective harbor structure 10 may be towed by a vessel 11 or otherwise moved (floated) from the construction or assembly site to an offshore site of operations, which is depicted in FIG. 5*a*. The floating modular protective harbor structure 10 is shown in cross section taken along the double arrow I-I in FIGS. 3*a* and 4. Referring now to FIG. 5*b*, upon arrival at the offshore site of operations, the floating modular protective harbor structure 10 is moved into a desired position at the site and submerged by ballasting at least some, if not all, of the modular flotation elements 20 of the modular flotation support 14 and reducing the length of the anchor line of the anchorage system 16, for example via a winch, such that the modular protective harbor wall 12 lies at a desired depth below the surface 58 at the offshore site. The depth may be sufficient to allow a floatable offshore rigsite vessel, such as a jackup 60, to move into position over the submerged floating modular protective harbor structure 10 with sufficient clearance with respect to the modular protective harbor wall 12. The anchorage system 16 may be deployed to maintain the position and depth of the floating modular protective harbor structure 10 as the jackup 60 is moved into place. It also may be expedient to maintain a small degree of positive buoyancy in the floating modular protective harbor structure 10 and to use the anchorage system 16 against the positive buoyancy to maintain the desired position and depth of the floating modular protective harbor structure 10. Accordingly, when the structure is submerged with a positive buoyancy, winches may be used to shorten or lengthen anchor lines to move the structure to deeper or shallower depths, respectively. When submerged, a positive buoyancy assures that the anchor lines are tensioned and may be used to assure that the structure does not sink.

Figure 5C:
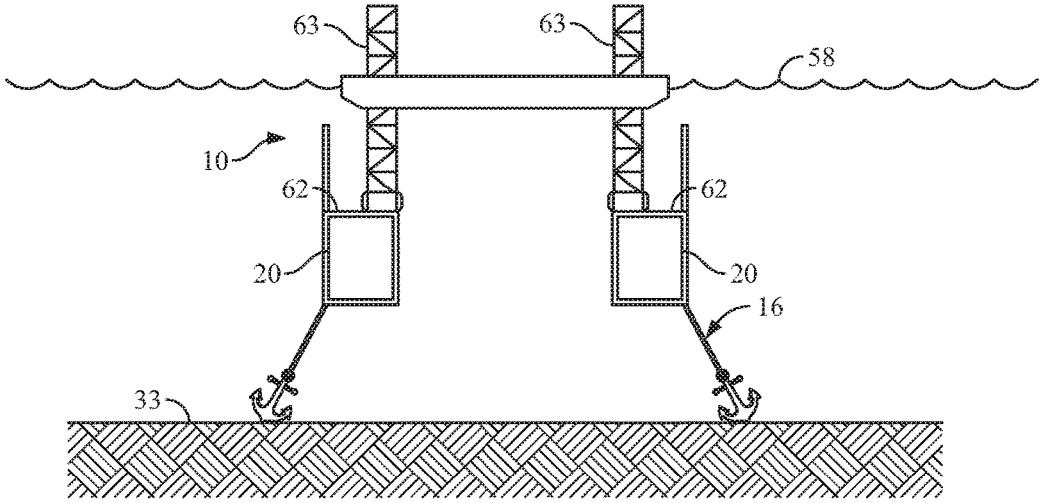
Figure 5D:
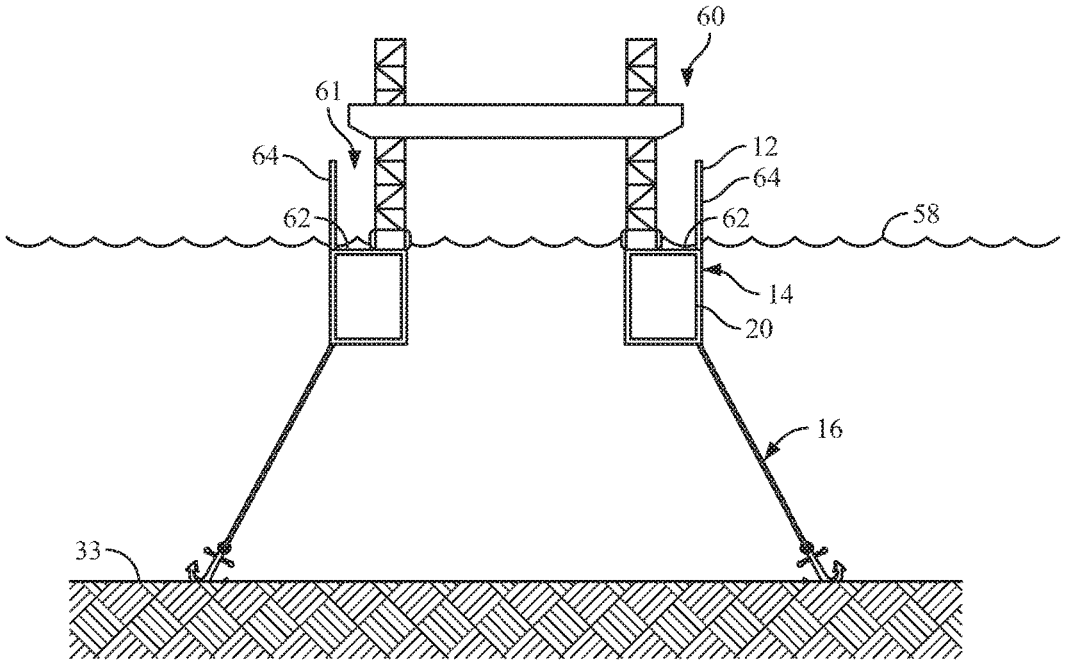

Referring now to FIG. 5*c*, once the jackup 60 is in place within the harbor to be formed by the submerged, floating protective harbor structure 10, the jack stands 63 of the jackup 60 may be extended (lowered) until their lower ends come into contact with and find support from upper surface portions 62 of the modular flotation elements 20 at a location that is radially interior of the modular protective harbor wall 12. As depicted in FIG. 5*d*, the modular flotation elements 20 are deballasted to an extent sufficient to raise the floating modular protective harbor structure 10 to a second depth where at least an upper portion 64 of the modular protective harbor wall 12 extends above the surface 58 at the offshore site such that the jackup 60 is enclosed within a harbor 61 established by the modular protective harbor wall 12. Once so positioned, the modular protective harbor wall 12 protects the jackup 60 from ice features in the body of water and other threats. Ice features may include icebergs, ice floes, pack ice, first-year ice, second-year ice or other multi-year ice, and combinations thereof. The anchorage system 16 of the floating modular protective harbor structure 10 may be deployed in the seabed 33 to maintain position and depth of the floating modular protective harbor structure 10 (as well as the jackup 60 harbored and supported upon it). It also may be expedient to maintain a small degree of ballast in the floating modular protective harbor structure 10 and use it in concert with deployment of the anchorage system 16 to maintain the desired position and depth of the floating modular protective harbor structure 10 in the raised position.

When so arranged in ice-prone offshore environments, operations on the jackup 60 may initiate earlier (at or near the conclusion of an ice season) and continue longer into the beginning of the next ice season within the protection of the harbor wall 12. This arrangement is beneficial when the jackup 60 itself is not an ice capable vessel capable of withstanding forces from contact with ice. Accordingly, the arrangement provides significant potential for enhancing equipment utilization and for gaining significant additional operational time in ice-prone offshore environments annually.

Figure 5E:
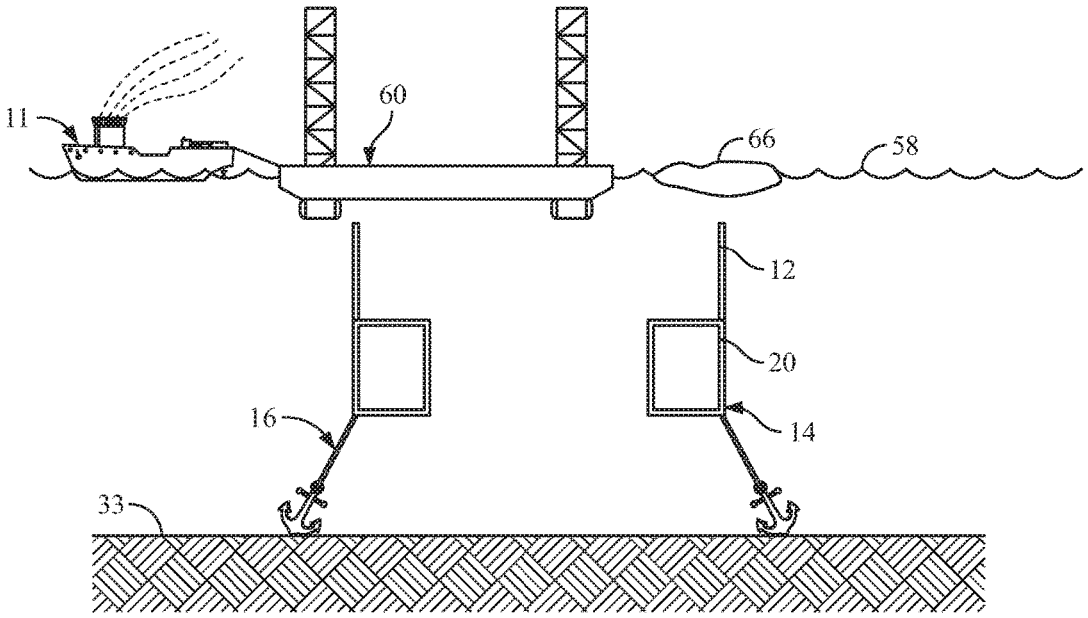

Referring now to FIG. 5*e*, at the conclusion of operations, the floating modular protective harbor structure 10 is again submerged to a depth sufficient for the jackup 60 to move from the site with clearance over the harbor wall 12. The submerged position is achieved by ballasting at least some, if not all, of the modular flotation elements 20 of the modular flotation support 14 such that the modular protective harbor wall 12 lies at the desired depth below the surface 58 at the offshore site. The move of the jackup 60 may be conducted with the assistance of an ice capable vessel 11. The floating modular protective harbor structure 10 may remain in the submerged position throughout the ice season of the ice-prone offshore environment at a depth sufficient to avoid impact damage from ice features 66 at the offshore site. The anchorage system 16 may be deployed to maintain the floating modular protective harbor structure 10 at the desired depth and location. Near conclusion of an ice season, the jackup 60 may be returned (perhaps with the assistance of ice capable vessel 11) and the sequence of events as described above may be repeated. Alternatively, the floating modular protective harbor structure 10 may be raised at an appropriate time and moved to another offshore site for reuse and to repeat the sequence of events as described above.

Although the above sequence of events are described with respect to a jackup 60, other offshore vessels described herein may be used. The offshore vessel may comprise any one or more of a variety of vessels, and in particular, any offshore vessels having utility in oil and/or gas exploration, in the development of oil and/or gas, and/or in the production of oil and/or gas (hydrocarbons).

Figure 6:
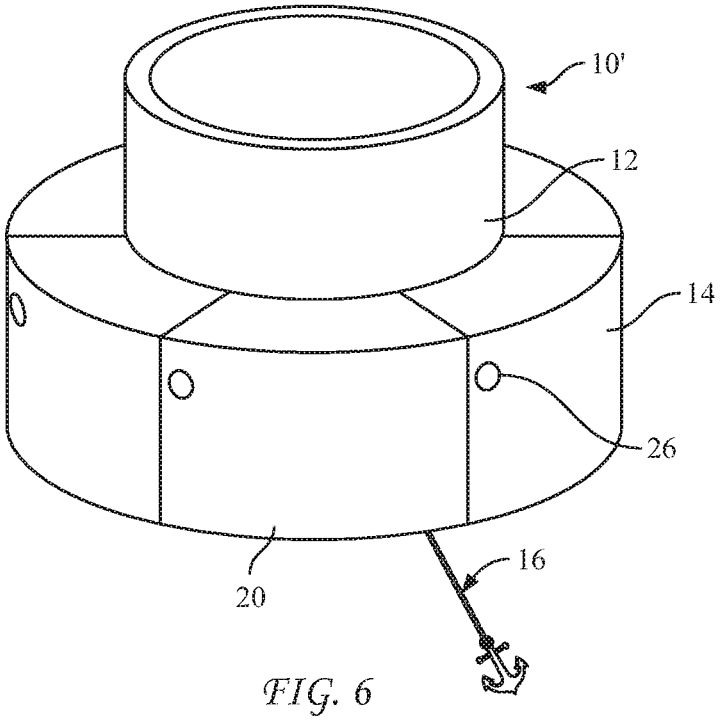
FIG. 6 is a perspective view of a floating modular protective harbor structure constructed and arranged in accordance with another embodiment of the present disclosure.
Figure 7:
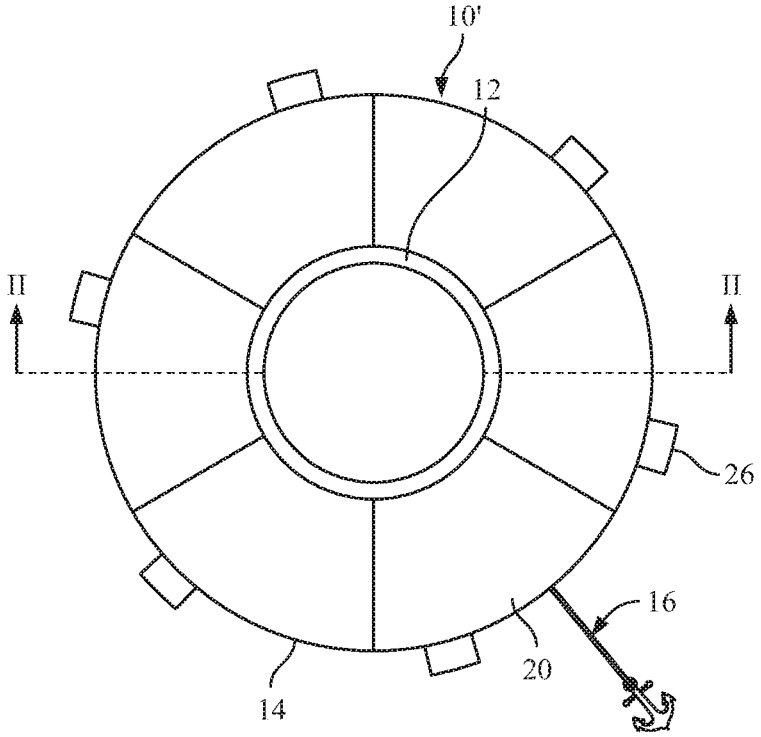
FIG. 7 is a top planar view of the floating modular protective harbor structure of FIG. 6.

Referring now to FIGS. 6 and 7, in another embodiment, the floating modular protective harbor structure 10' may comprise a modular protective harbor wall 12, a modular flotation support 14 and anchorage system 16 as described herein, but with the modular flotation elements 20 of the modular flotation support 14 being circumferentially disposed around an outer peripheral portion of modular protective harbor wall 12. By such arrangement the space (harbor) enclosed by the modular protective harbor wall 12 is free of a presence of the modular flotation support 14.

Figure 8A:
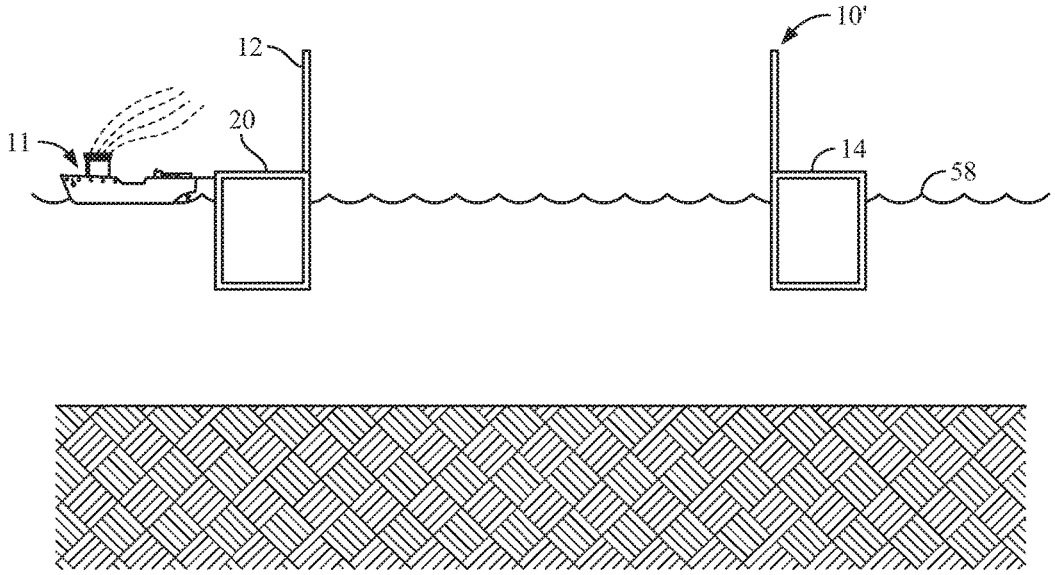
FIGS. 8*a-d* provide a representation of an exemplary deployment sequence of the floating modular protective harbor structure of FIG. 7 and a MODU vessel at an offshore site of operations in an ice-prone offshore environment with the floating modular protective harbor structure being shown in cross-section taken from the perspective of double arrow II-II in FIG. 7.
Figure 8B:
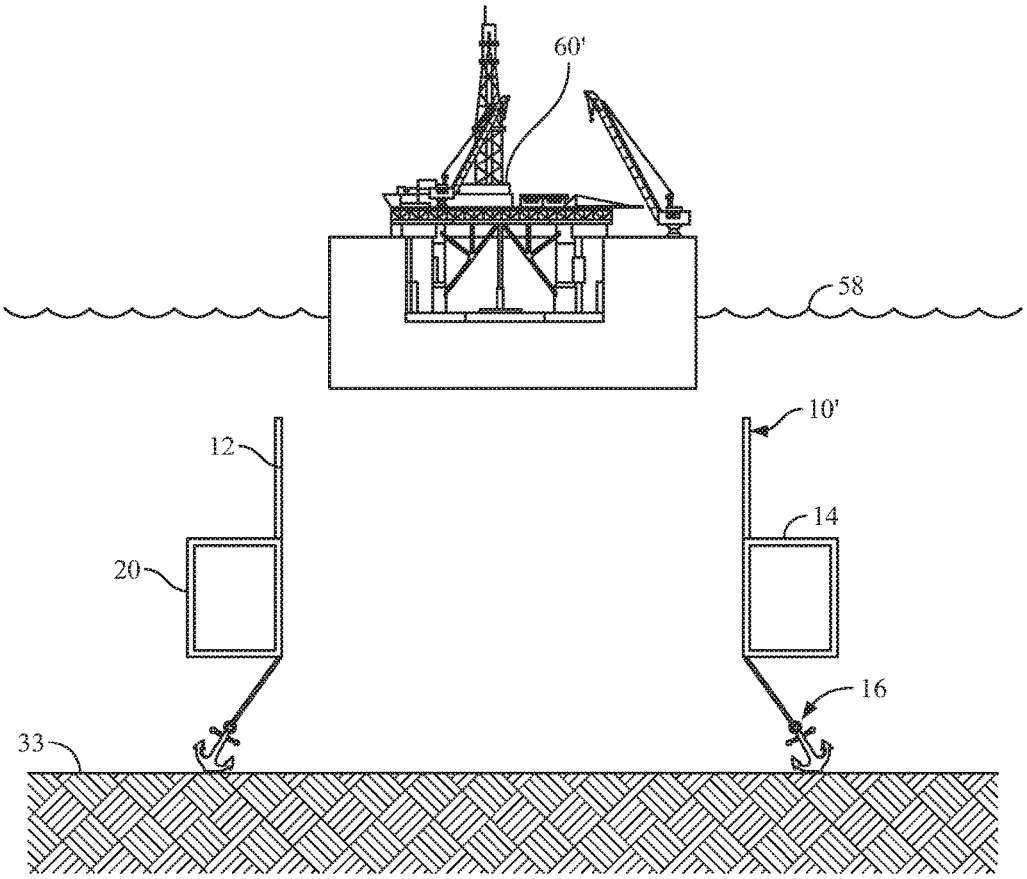
Figure 8C:
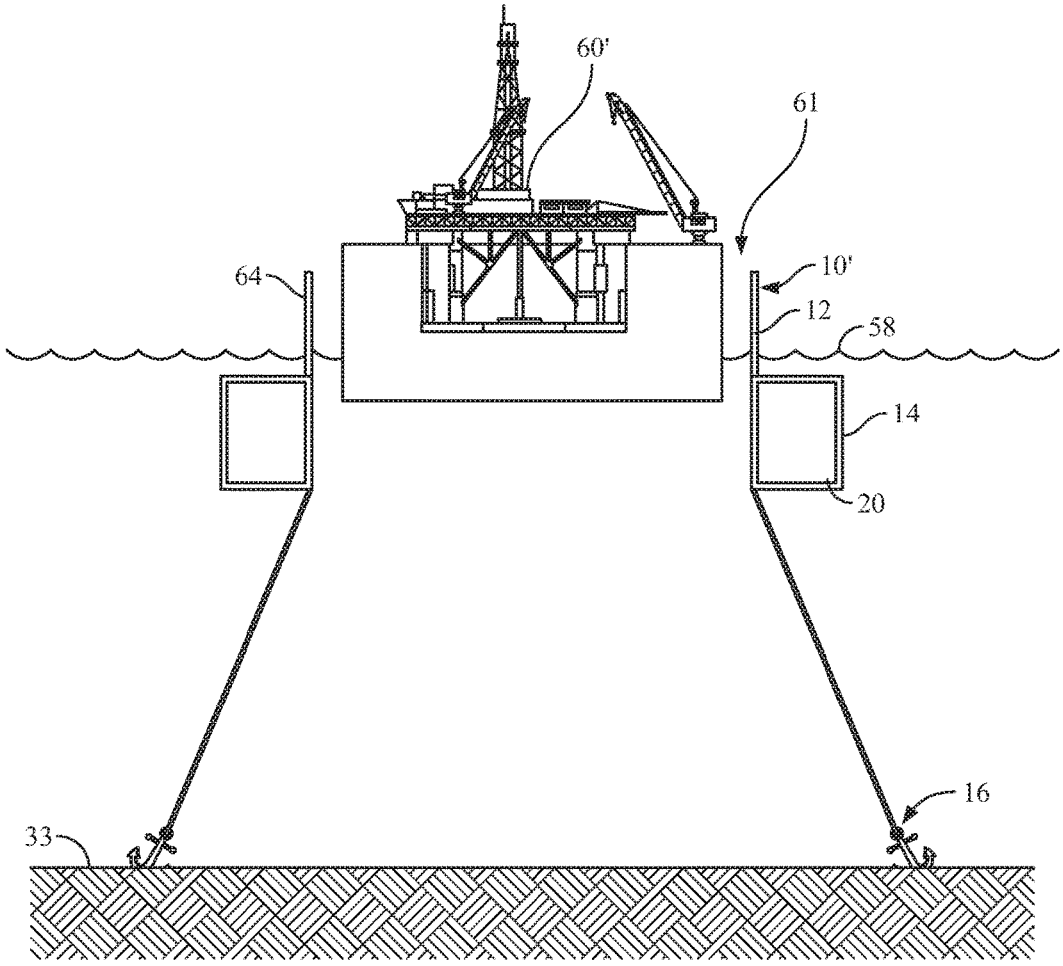

Referring now to FIGS. 8*a-d*, the floating modular protective harbor structure 10' of FIGS. 6 and 7 is moved into position at an offshore site of operations, as shown in FIG. 8*a*, whereupon it is submerged, as shown in FIG. 8*b*, to a depth sufficient for floating a MODU vessel 60' to be moved into position over the submerged floating modular protective harbor structure 10'. The anchorage system 16 may be deployed at or about this time to maintain depth and position of the floating modular protective harbor structure 10'. As in the previously described sequence of events, the submerged floating modular protective harbor structure 10' is then raised to a raised position, as shown in FIG. 8*c*, to a depth sufficient to expose at least an upper portion 64 of the modular protective harbor wall 12 above the surface 58 so as to provide a protected harbor 61 for the MODU vessel 60'. The MODU vessel 60' is then moored (not shown) either to the floating modular protective harbor structure 10 or alternatively or in addition directly to the seabed 33.

Figure 8D:
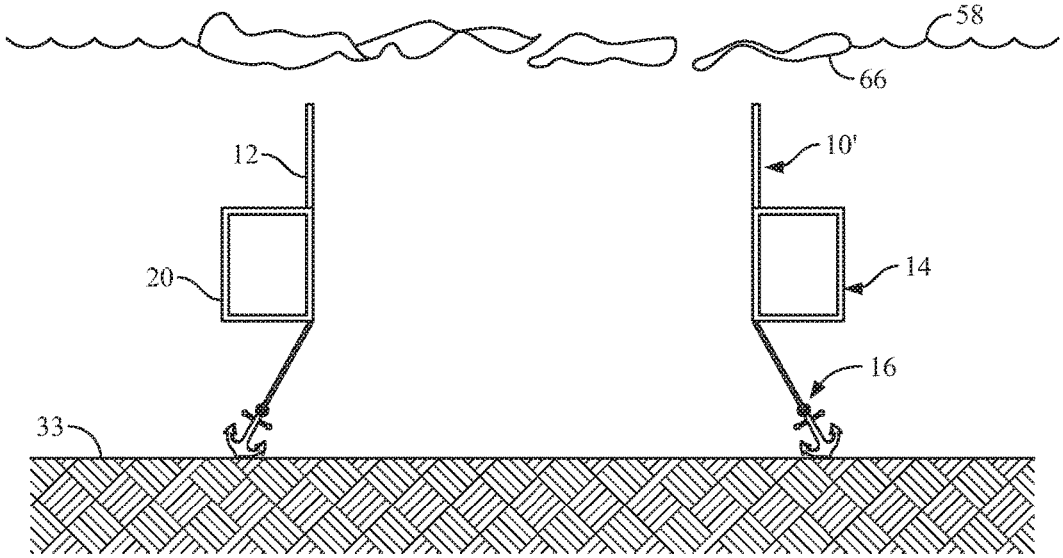

Referring now to FIG. 8*d*, at conclusion of operations, the floating modular protective harbor structure 10' is again submerged to a depth sufficient for the MODU vessel 60' to move from the site with clearance over the harbor wall 12, which move of the MODU vessel may be undertaken with the assistance of an ice capable vessel. The floating modular protective harbor structure 10' may remain submerged throughout the ice season of the ice-prone offshore environment at a depth sufficient to avoid impact damage from ice features 66 at the site. During such time, the anchorage system 16 may be deployed to maintain the floating modular protective harbor structure 10 at the desired depth and location. Near the conclusion of an ice season, the MODU vessel 60' may be returned (perhaps with the assistance of ice capable vessel) and the sequence of events as described above may be repeated. Alternatively, the floating modular protective harbor structure 10' may be raised at an appropriate time and moved to another offshore site for reuse and to repeat the sequence of events as described above.

Figure 10A:
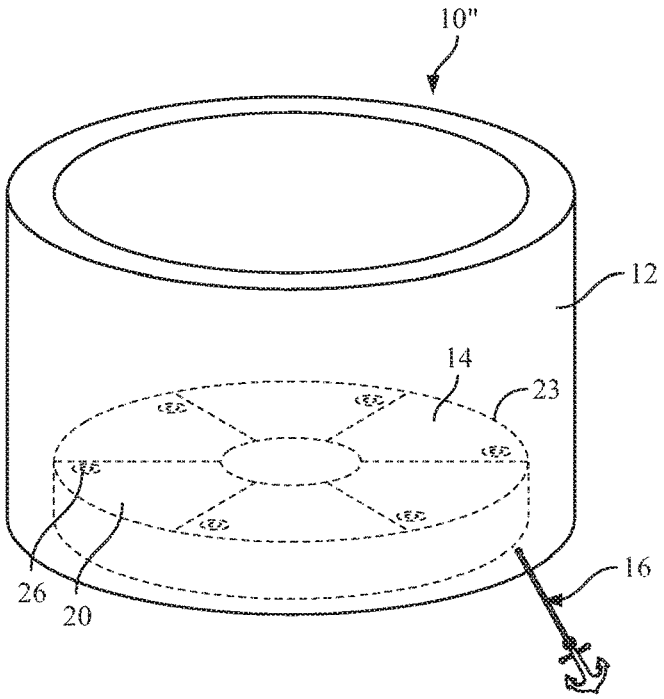
FIG. 10*a* and FIG. 10*b* is a perspective view and a top view, respectively, of a floating modular protective harbor structure constructed in accordance with another embodiment of the present disclosure.
Figure 10B:
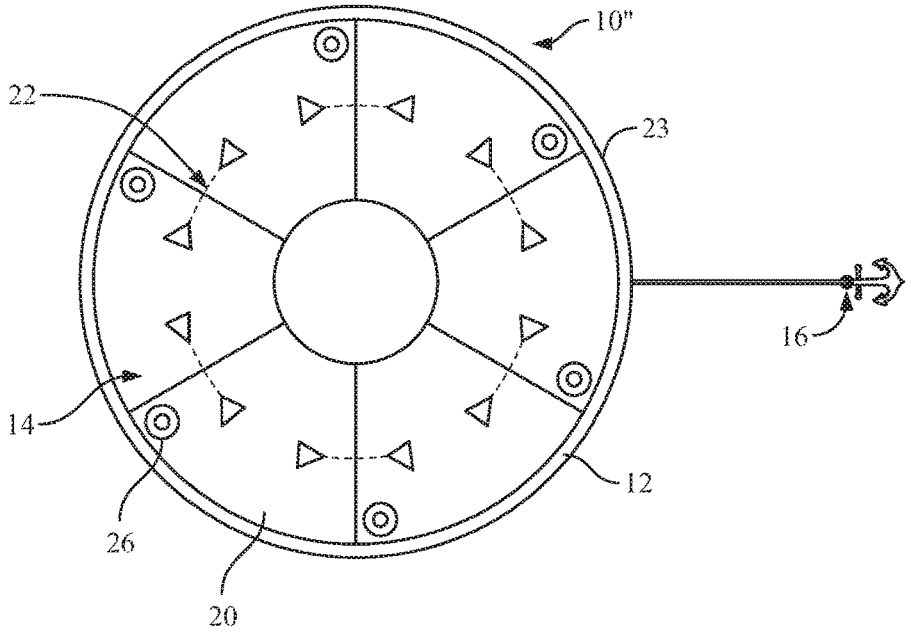

Referring now to FIGS. 10*a* and 10*b*, in yet another embodiment, the floating modular protective harbor structure 10" may comprise a modular protective harbor wall 12, a modular flotation support 14 and anchorage system 16 as described herein, but with the modular flotation elements 20 of the modular flotation support 14 being disposed within the interior of modular protective harbor wall 12 and operatively coupled thereto. By such arrangement the space (harbor) enclosed by the modular protective harbor wall 12 is provided with a shelf by the presence of the modular flotation elements 20 for supporting jack stands or the like. In the arrangement, the modular protective harbor wall 12 encloses and protects the modular flotation elements 20, and the disposition of the annulus 23 of the modular flotation elements 20 may serve to reinforce (brace) the modular protective harbor wall 12. The embodiment of FIGS. 10*a* and 10*b* may be deployed in accordance with a sequence of events as described with reference to FIGS. 5*a-d* and/or FIGS. 8*a-d*.

Figure 11A:
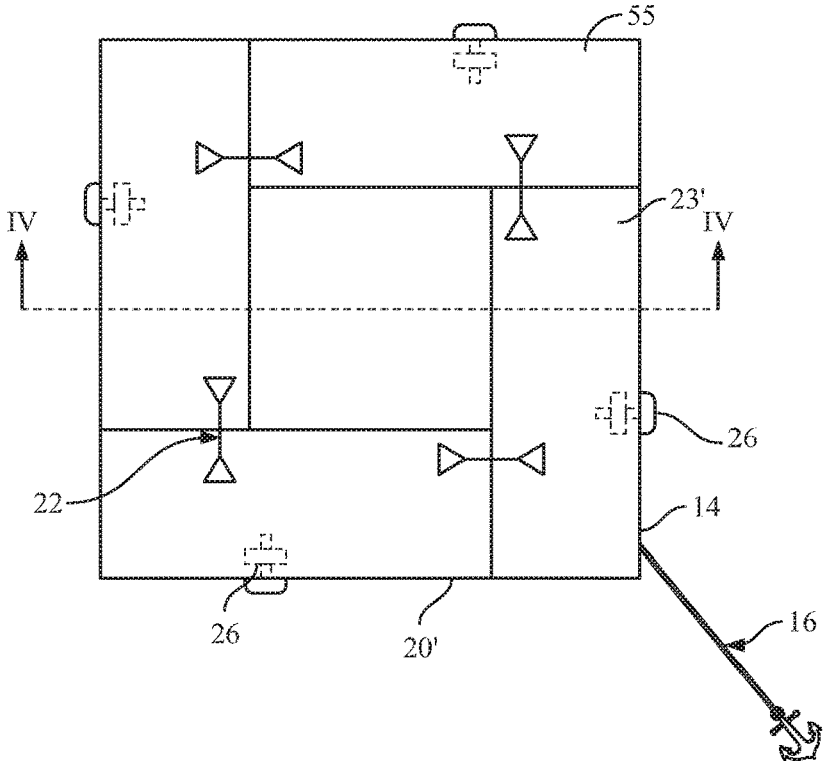
FIG. 11*a* and FIG. 11*b* are top planar views of a modular flotation support and a modular protective harbor wall, respectively, of a floating modular protective harbor structure in accordance with a rectangular embodiment of the present disclosure.
Figure 11B:
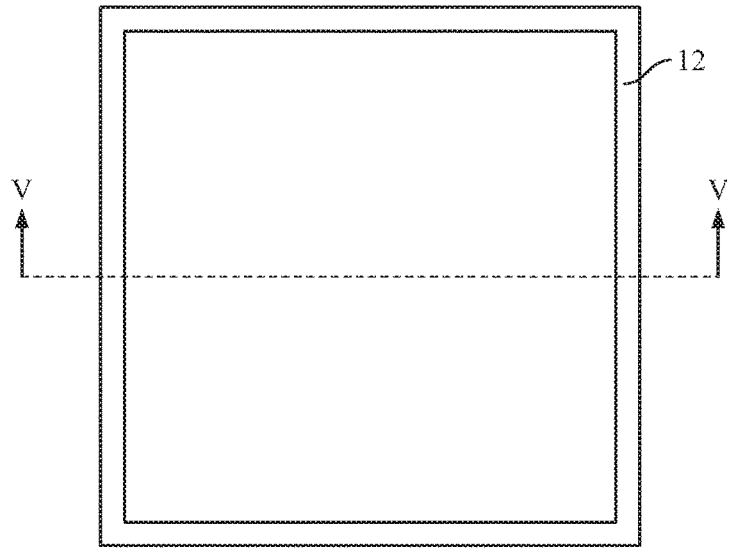
Figure 12:
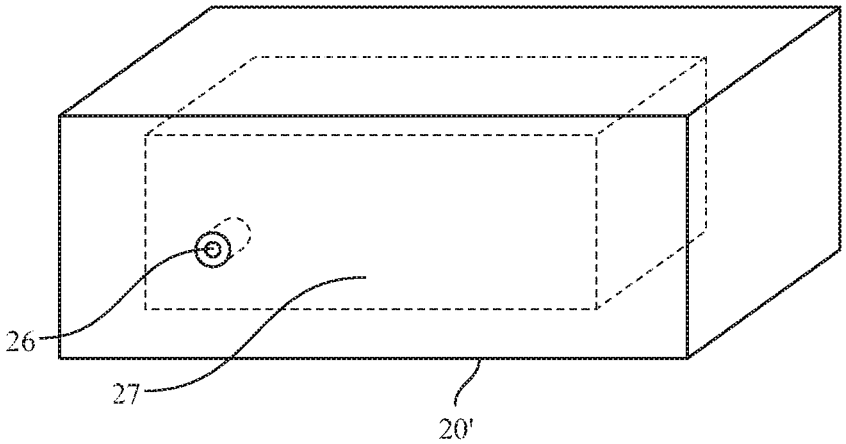
FIG. 12 is a perspective view of a discrete flotation element of the modular flotation support shown in FIG. 11*a*.

Referring now to FIGS. 11*a* and 11*b* in yet another embodiment, the floating modular protective harbor structure may comprise a rectangular modular protective harbor wall 12, a rectangular modular flotation support 14 and anchorage system 16 as described herein, but with modular flotation elements of the modular flotation support 14 each being in the form of a discrete, modular rectanguloid flotation block 20', such as shown in FIGS. 11*a* and 12. In the present embodiment, the modular rectanguloid flotation blocks 20' are operatively coupled together in an exemplary end to side relation and secured by connectors 22 to form a rectangular annulus 23'. As in the embodiment described with respect to FIGS. 1 and 3*b*, each modular rectanguloid flotation block 20' includes an inner chamber 27 and an arrangement 26 including a ballast pump, valve, and conduit (not shown) operative to ballast and deballast (purge or remove ballast fluid from) the inner chamber 27. The exemplary rectangular annulus 23' of FIG. 11*a* comprises four modular rectanguloid flotation blocks 20'; however, a greater number of modular rectanguloid flotation blocks 20' may be employed to construct a different form of a rectangular annulus 23' (such as a more elongate or deeper one) or other form of shaped body for the modular flotation support 14.

Figure 13:
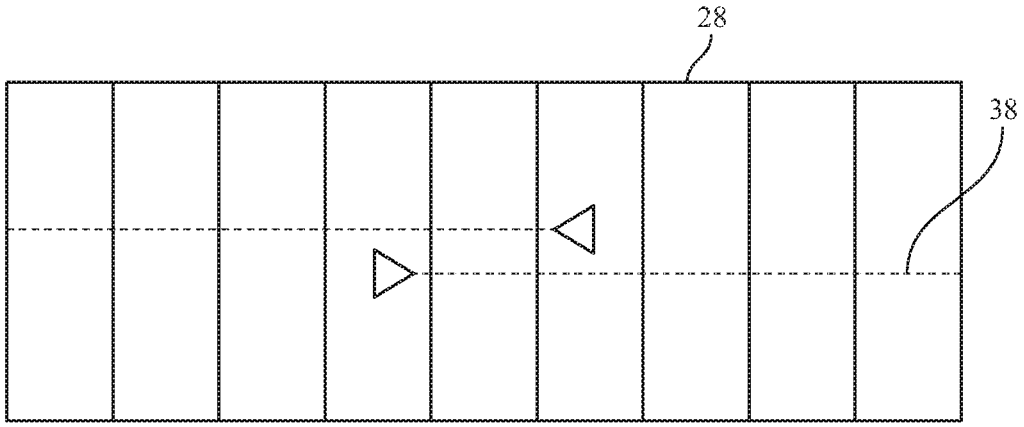
FIG. 13 is a side planar view of the modular protective harbor wall shown in FIG. 11*b*.

Referring now to FIGS. 11*b* and 13, the rectangular modular protective wall 12 of the present embodiment is constructed of vertically oriented panels 28 and a post-cast tensioner 38 as described with regard to the embodiment in reference to FIG. 2. Alternatively, the plurality of vertically oriented panels 28 may be operatively coupled with a circumferential wire wrapping thereabout with a protective layer applied thereto. Alternatively, panels 28 may instead be oriented horizontally, as shown in FIG. 9. Once constructed, the rectangular modular protective harbor wall 12 may be attached to the rectangular modular flotation support 14 such that protective wall 12 is situated upon the outer perimeter 55 of the rectangular modular flotation support 14.

The embodiment of FIGS. 11*a* and 11*b* is suited for deployment in ice-prone offshore environments, such as being deployed in accordance with a sequence of events as described with reference to FIGS. 5*a-d*, wherein the rectangular modular flotation support 14 may be represented from the perspective of the double arrow IV-IV in FIG. 11*a* and the rectangular modular protective harbor wall 12 may be represented from the perspective of the double arrow V-V in FIG. 11*b*.

Figure 14A:
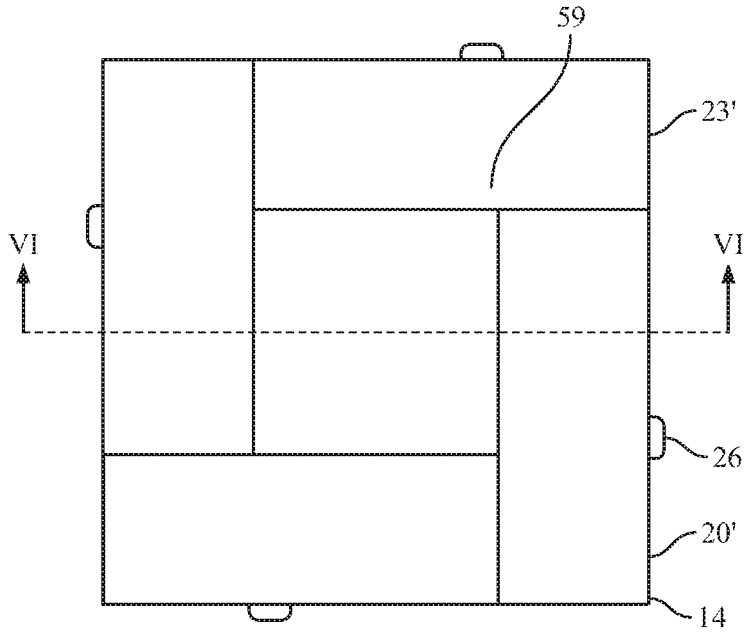
FIG. 14*a* and FIG. 14*b* are top planar views of a modular flotation support and a modular protective harbor wall, respectively, of a floating modular protective harbor structure in accordance with another rectangular embodiment of the present disclosure.
Figure 14B:
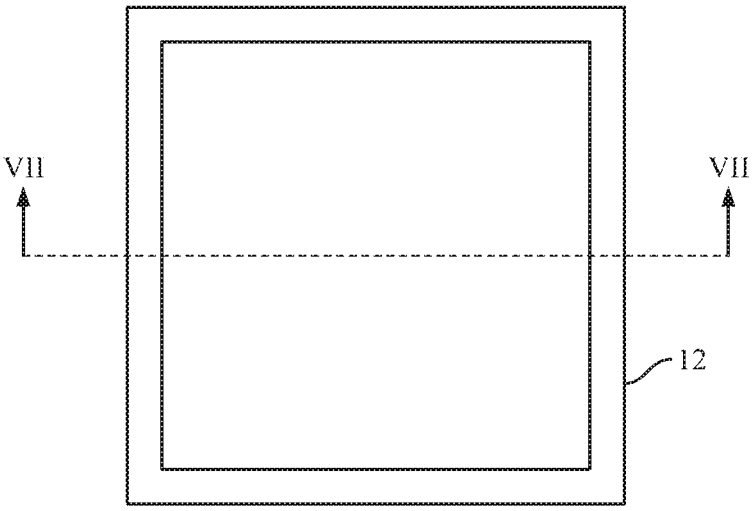

Referring now to FIGS. 14*a* and 14*b* in still another embodiment, the floating modular protective harbor structure may comprise a rectangular modular protective harbor wall 12, a rectangular modular flotation support 14 and anchorage system 16 as described with reference to FIGS. 11*a* and 11*b*, but where the relative size and/or dispositions of the rectangular protective harbor wall 12 and the rectangular flotation support 14 are such that the rectangular modular protective harbor wall 12 is situated atop an inner periphery 59 of the rectangular annulus 23' of the flotation support 14. Alternatively, the modular protective harbor wall 12 may be situated to extend at least partially through the opening defined by the rectangular annulus 23'. Otherwise the construction and features of the embodiment shown in FIGS. 14*a* and 14*b* is similar to those of FIGS. 11*a* and 11*b* and is suited for deployment in ice-prone environments such as being deployed in accordance with a sequence of events as described with reference to FIGS. 8*a-d*, wherein the rectangular modular flotation support 14 of FIG. 14*a* may be represented from the perspective of the double arrow VI-VI in FIG. 14*a* and the rectangular modular protective harbor wall 12 of FIG. 14*b* may be represented from the perspective of the double arrow VII-VII in FIG. 14*b*.

Figure 17:
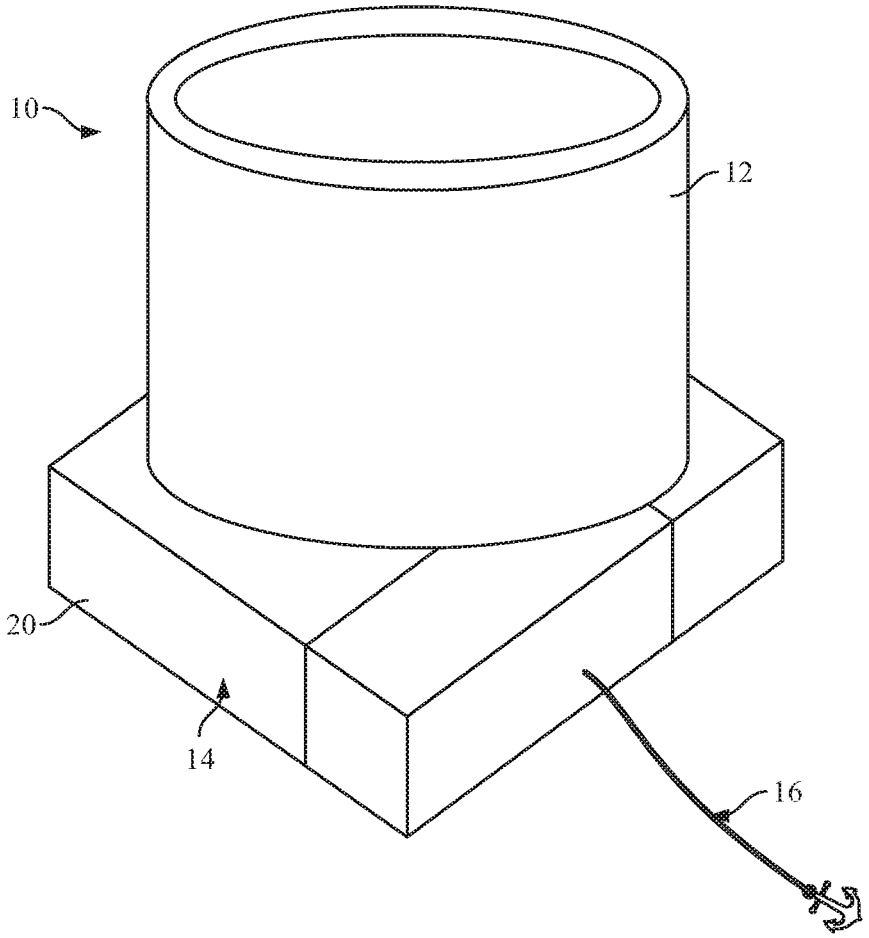
FIG. 17 is a perspective view of a floating modular protective harbor structure in accordance with still another embodiment of the present disclosure.

Referring now to FIG. 17, it is contemplated that a cylindrical protective harbor wall 12 may be combined with the rectangular modular flotation support 14 and, although not shown, a rectangular protective harbor wall 12 may be combined with a circular modular flotation support 14.

Figure 15:
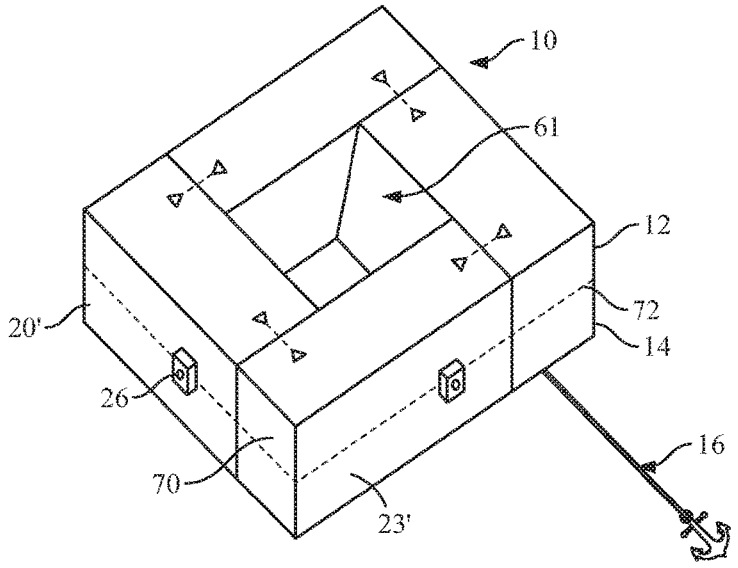
FIG. 15 is a perspective view of a floating modular protective harbor structure in accordance with another embodiment of the present disclosure with the modular flotation support and the modular protective harbor wall being integrated.

Referring now to FIG. 15, in still another embodiment, the floating modular protective harbor structure 10 may comprise a modular flotation support 14 and a modular protective harbor wall 12, wherein the modular flotation support 14 comprises a plurality of modular rectanguloid flotation blocks 20' as described with reference to FIGS. 11*a* and 12, and wherein the modular protective harbor wall 12 comprises an upper portion 70 of modular rectanguloid flotation blocks 20' that is disposed above a waterline 72 when the floating modular protective harbor structure 10 is in a raised position.

Figure 16:
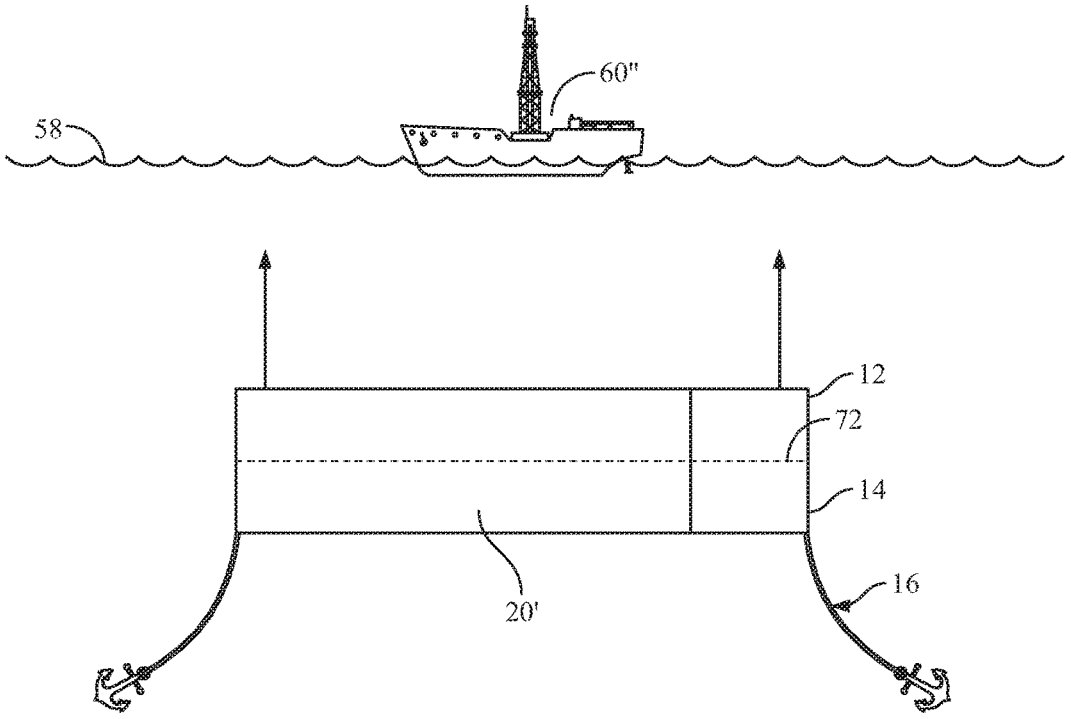
FIG. 16 is a representation of a deployment of the floating modular protective harbor structure shown in FIG. 15.

Referring now to FIG. 16, the floating modular protective harbor structure 10 shown and described with reference to FIG. 15 may be constructed and towed to an offshore site of operations in a floating condition and upon being positioned at the site submerged beneath the surface 58. Thereupon, and offshore rig site vessel 60", such as a service platform vessel, may be moved into position above harbor space 61 defined within the rectangular annulus 23' of the floating modular protective harbor structure 10. At least some of modular rectanguloid flotation blocks 20' may then be the deballasted so as to raise the floating modular protective harbor structure 10 to the surface such that the upper portion 70 of modular rectanguloid flotation blocks 20' extends above the surface 58 at the offshore site so as to provide a protective harbor 61 to the vessel 60". Upon conclusion of operations, modular rectanguloid flotation blocks 20' may then be ballasted so that the floating modular protective harbor structure 10 may be returned to a submerged position and stowed during the ice season at the site. Throughout the sequence of operations at the site, the anchorage system 16 of the floating modular protective harbor structure 10 may be deployed to maintain position and depth of the floating modular protective harbor structure 10.

Figure 18C:
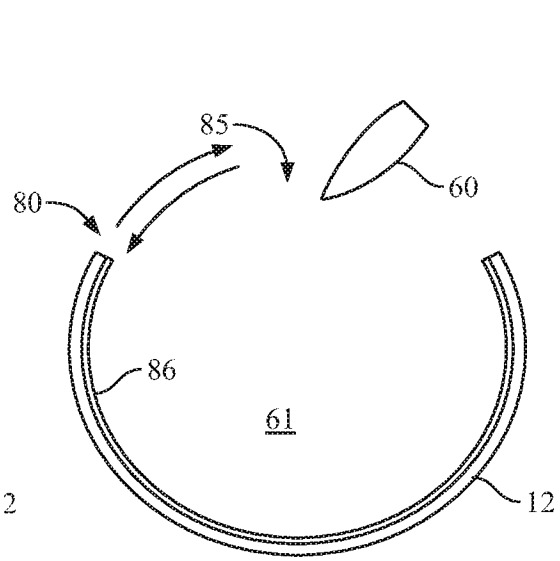
FIGS. 18*a-c* are top planar representations of protective harbor walls which include features of a gate suitable for application in the various embodiments of the modular protective harbor structures disclosed herein.
Figure 18B:
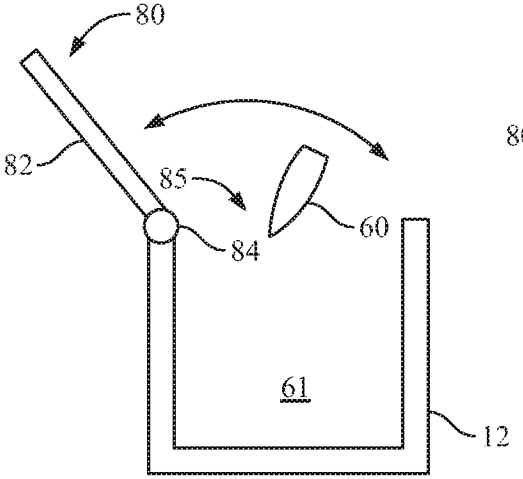
Figure 18A:
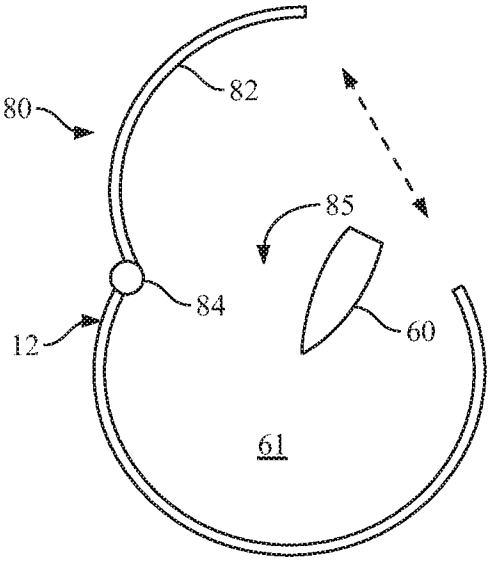

The embodiments described herein may be provided with enhanced harbor operation and access by provision of a gate 80, which in the case of the embodiments shown in FIGS. 18*a* and 18*b*, may comprise a pivotable floating gate 82 that may pivot about a hinge 84 to an open position where offshore vessels 60 may enter or leave the harbor 61 defined by the modular protective harbor wall 12 through the opening 85 and a closed position where vessel 60 may be moored and protected within the harbor 61 enclosed by the modular protective harbor wall 12 and the closed gate 80.

In the embodiment of FIG. 18*c* the gate 80 comprises a sliding partition 86 that is disposed concentrically with respect modular protective harbor wall 12. In an embodiment, the sliding partition 86 is a floating partition. The partition 86 is particularly suited to embodiments herein whose modular protective harbor wall 12 is cylindrical. As shown in FIG. 18*c*, the partition 86 is movable from an open position where offshore vessels 60 may enter or leave the harbor 61 defined by the modular protective harbor wall 12 through the opening 85 and a closed position where vessel 60 may be moored and protected within the harbor 61 enclosed by the modular protective harbor wall 12 and the closed gate 80.

With embodiments that include a gate 80, such as any of those described with reference to FIGS. 18*a-c*, the floating modular protective harbor structure may be transported to the offshore site and raised in the absence of the offshore vessel 60, which may thereafter be moved into the protective harbor 61 upon opening the gate 80. The offshore vessel 60 need not be pre-positioned proximate the location of operations and within the harbor to be formed by the protective harbor wall 12 before the protective harbor wall is raised. Likewise, at the conclusion of operations, the offshore vessel 60 may be moved out of the harbor by opening the gate 80. The gate 80 may be opened and closed to accommodate the ingress or egress of the offshore vessels 60 into and out of the harbor space defined by the modular protective harbor wall 12 without completely submerging the floating modular protective harbor structure.

Figure 19A:
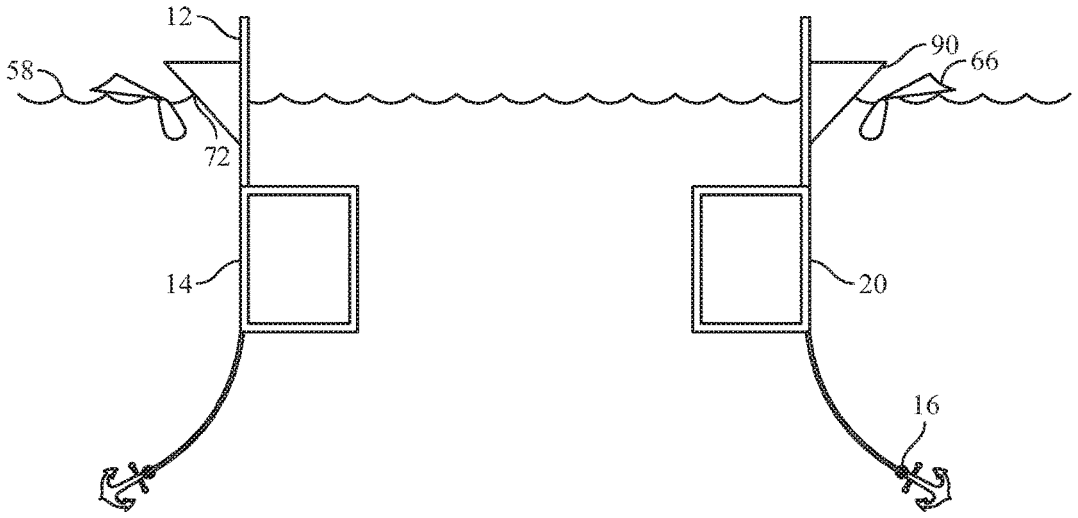
FIGS. 19*a* and *b* are cross-sectional representations of the floating modular protective harbor structures of the various embodiments with arrangements to deflect ice features.
Figure 19B:
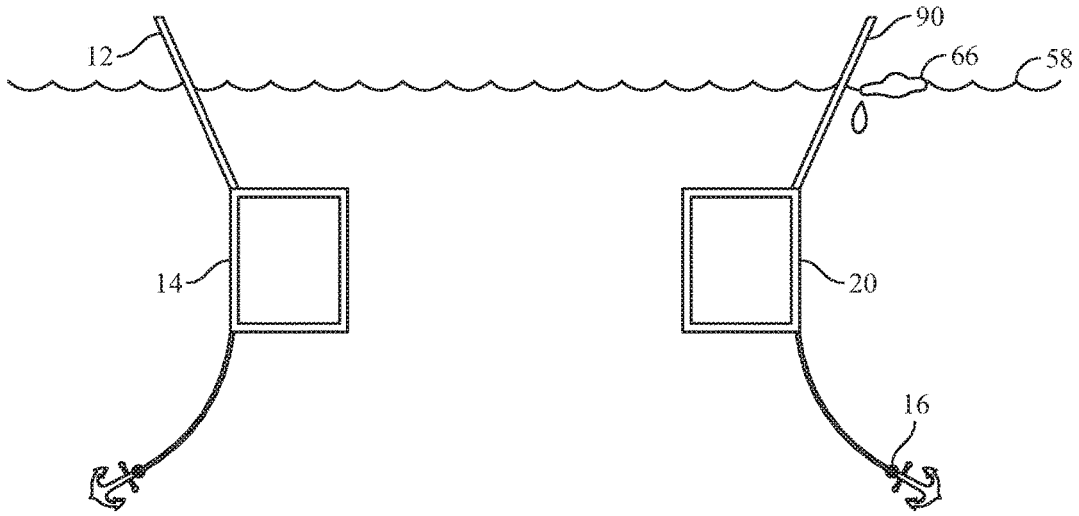

Referring now to FIGS. 19*a* and 19*b*, the protective harbor wall 12 of the embodiments described herein may be provided enhanced resistance to ice features in the body of water by provision of deflectors 90 around the exterior of the protective harbor wall 12 at or about the waterline (or surface 58), such that an ice feature 66 in the body of water is directed (deflected) downwardly and broken up. With the downward deflection of the ice features 66, an upward reactive force against the deflector 90 of the protective harbor wall 12 helps maintain the position and depth of the floating modular protective harbor structure 10 in the water.

The modular protective structure and protective harbor wall may be constructed and arranged to have a strength sufficient to withstand at least first-year ice conditions. First-year ice conditions include ice thicknesses up to 2 meters (m) which may also include first-year ice ridges. The modular protective structure and protective harbor wall may be constructed and arranged to have a strength sufficient to withstand second-year ice conditions or other multi-year ice conditions. Such second-year ice conditions or other multi-year ice conditions may be of varying strengths and thicknesses typically associated with such ice. Being able to withstand second-year ice conditions or other multi-year ice conditions can provide a year round capacity to protect the non-ice capable offshore vessel within the harbor.

In the embodiment shown in FIG. 19*b*, the deflector 90 is an inclination of the substantial length of the protective harbor wall 12 such that moving ice features 66 contacting the protective harbor wall 12 are directed downwardly. Alternatively, only a portion of the length of the protective harbor wall 12 at or about the waterline (or surface 58) is inclined such that moving ice features 66 contacting such inclined portion of the protective harbor wall 12 are directed downwardly.

Referring now to FIGS. 20*a-d*, there is provided a method of constructing a floating modular protective harbor structure 10 by an assembly sequence of its modular components.

Figure 20A:
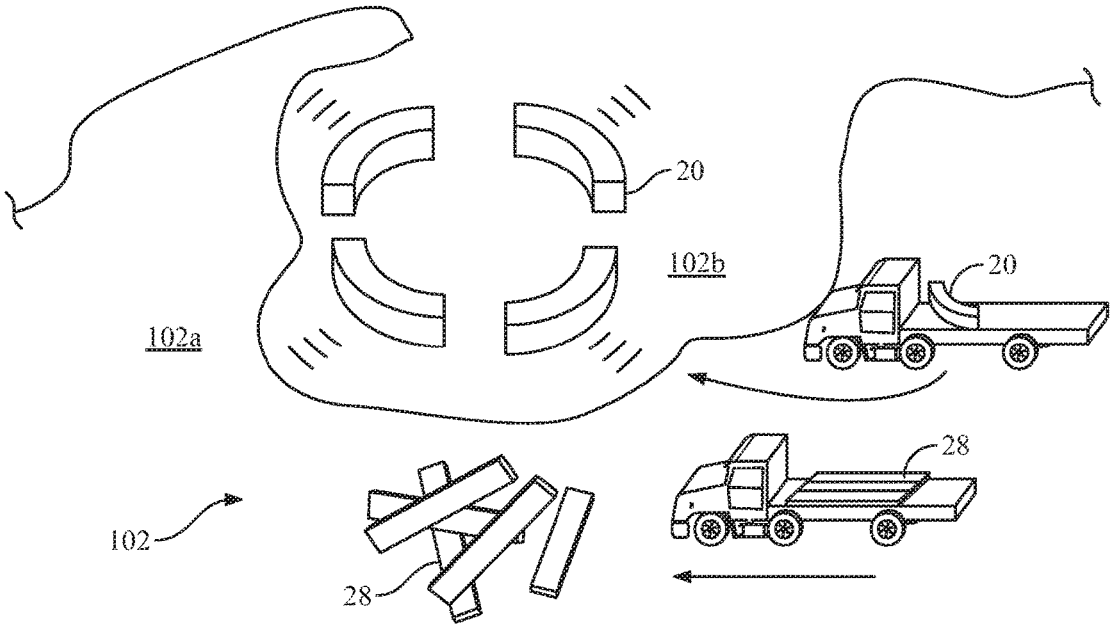
FIGS. 20*a-d* comprise a representation of an exemplary construction sequence of a floating modular protective harbor structure in accordance with an embodiment of the present disclosure.

Referring now to FIG. 20*a*, at assembly site 102, modular panels 28 for the modular protective harbor wall 12 are transported to the assembly site 102, or alternatively, the modular panels 28 are themselves constructed at the assembly site 102. The assembly site 102 may include a land-based portion 102*a* and a water-based portion 102*b*.

Figure 20B:
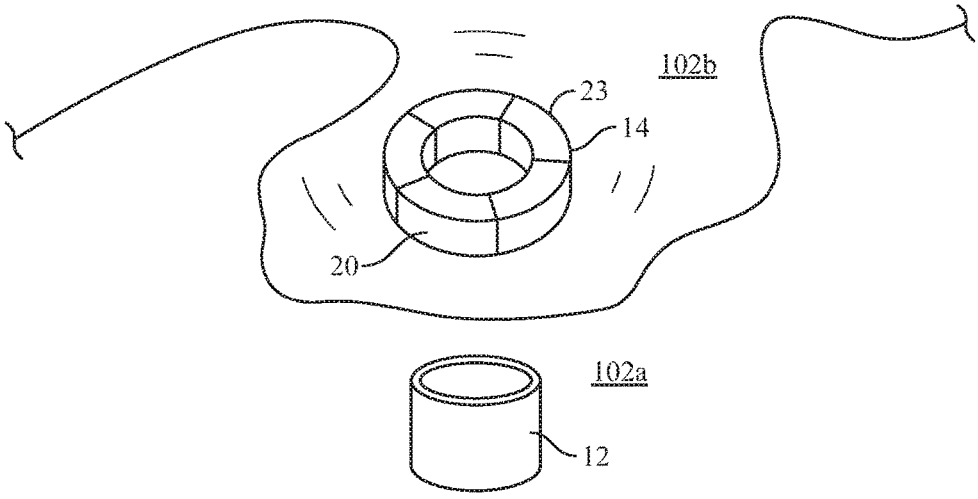

Likewise, the modular flotation elements 20 of modular flotation support 14 are either transported to the assembly site 102 or alternatively, constructed at the assembly site 102 with materials, such as concrete and/or steel, that are available at the assembly site 102 or transported to the assembly site 102. Referring now also to FIG. 20*b*, in an embodiment, each of the modular flotation elements 20 are then launched individually into a body of water 102*b* and brought together and operatively coupled in the form of the annulus 23 of the modular flotation support 14 while floating. In the alternative, some or all of the modular elements 20 may be operatively coupled together on land 102*a* and then launched into a body of water 102*b*. The assembly of the modular protective harbor wall 12 proceeds on land 102*a* at the assembly site 102; however, in other embodiments, the modular protective harbor wall 12 may be constructed in whole or in part directly upon the operatively coupled modular flotation elements 20 instead of being constructed separately from the modular flotation support 14.

Figure 20C:
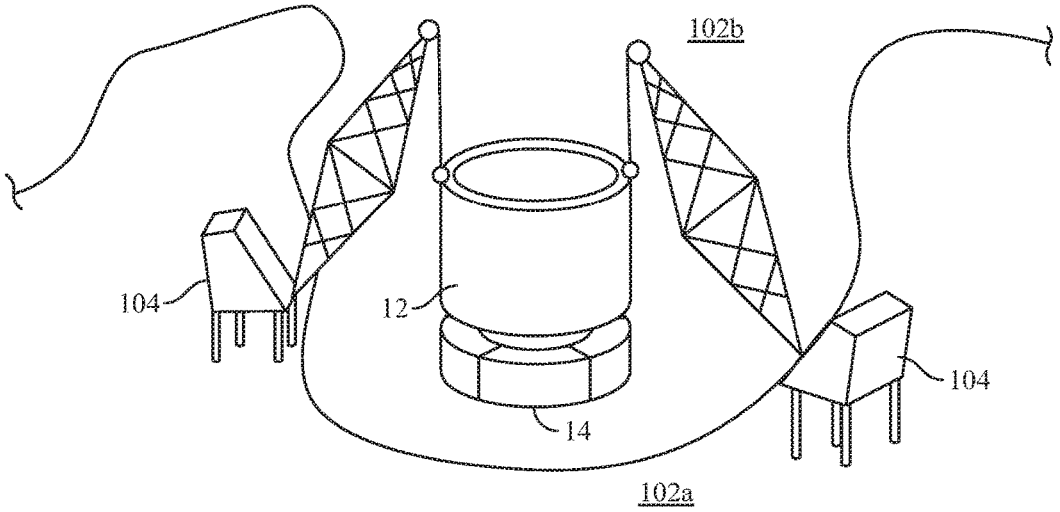
Figure 20D:
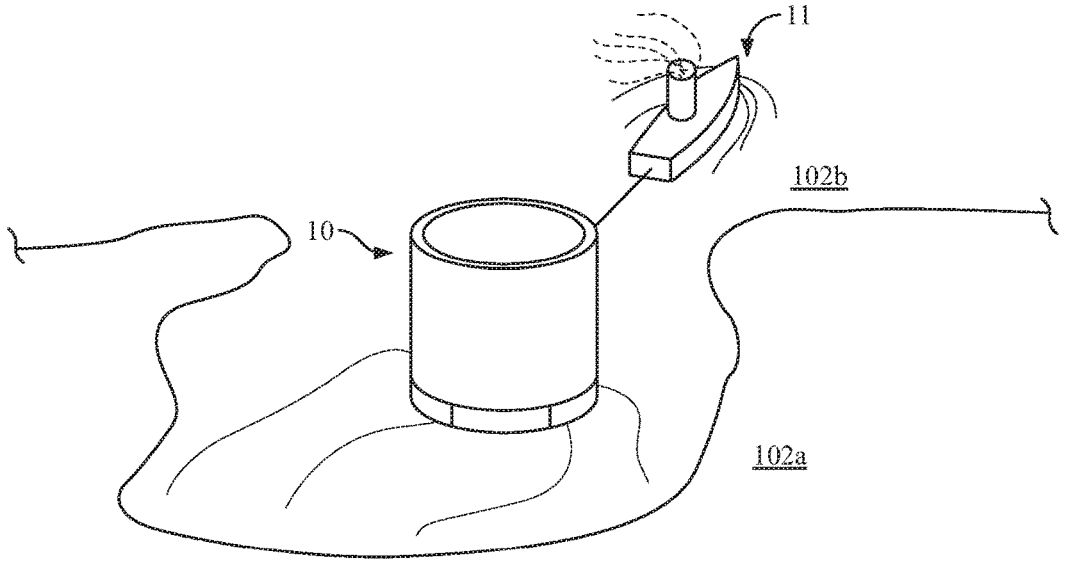

Referring now to FIG. 20*c*, in an embodiment, upon completion of the assembly of the modular flotation support 14 and the modular protective harbor wall 12, water-based or land-based, heavy lift equipment 104 may place the modular protective harbor wall 12 upon the modular flotation support 14 whereupon the modular protective harbor wall 12 and the modular flotation support are operatively coupled together (secured together) and readied to be moved (towed) with vessel 11 from the assembly site 102 to the offshore site of operations, as shown in FIG. 20*d*.

The above described method of assembly is advantageous in facilitating construction of a large seaworthy structure, such as the floating modular protective harbor structure 10, in regions of the world, such as ice-prone offshore environments, where large-scale dry docks and other resources may not be available or at best limited in size and/or capability.

The above teachings also permit the use a non-ice capable vessel in combination with an ice-protective floating modular harbor structure which avoids a need for vessel strengthening associated with ice capable vessels and also accommodates use of any widely available non-ice capable vessels by separating the ice-resistance function from the exploration, development, and/or production activities of the vessel. The "harbor" also makes it possible to extend the service time of such vessels in ice-prone offshore environments, such as Arctic or sub-Arctic offshore environments, which enhances utilization of such vessels and provides opportunity for increasing operating income with the extension of service time. The stowing of the modular protective harbor structure during times of heavier ice conditions simplifies operations. It is also possible to provide the protective harbor wall with sufficient strength through bracing, advanced design, selection of materials and other resources to achieve enhanced capability to resist ice features and provide a "harbor" having an extended operating capability, such as near year-round or year-round operating capability, in ice-prone offshore environments.

INDUSTRIAL APPLICABILITY

The structures and methods disclosed herein are applicable to the oil and gas industry.

Illustrative, non-exclusive examples of structures and methods according to the present disclosure have been presented. While the present disclosure may be susceptible to various modifications and alternative forms, the exemplary embodiments discussed herein have been shown only by way of example. However, it should again be understood that the present disclosure is not intended to be limited to the particular embodiments disclosed herein. Indeed, the present disclosure includes all alternatives, modifications, and equivalents falling within the true spirit and scope of the appended claims.

What is claimed is:

1. A modular structure for protecting an offshore vessel in a body of water from forces of ice features in the body of water, the modular protective structure comprising: a protective harbor wall constructed and arranged to enclose a harbor space, the harbor space being sized to receive the offshore vessel, and the protective harbor wall constructed and arranged to counteract the forces of ice features in the body of water; and a flotation support supporting the protective harbor wall, wherein the flotation support has a capacity to position the modular protective structure at a raised position where the flotation support is in a floating condition below a surface of the body of water and where the flotation support maintains at least a portion of the protective harbor wall above the surface of the body of water such that a harbor is established and the offshore vessel is protected by the protective harbor wall from the forces of ice features in the body of water; wherein the protective harbor wall is a modular protective harbor wall comprising a plurality of discrete elements operatively coupled together to form the modular protective harbor wall which is open at the top and the bottom; and the plurality of discrete elements comprises a plurality of precast concrete panels, the plurality of precast concrete panels operatively coupled together using a wire wrapping circumferentially disposed around the plurality of precast concrete panels and a layer of shotcrete disposed over the wire wrapping.

2. The modular protective structure of claim 1, wherein the flotation support has a capacity to change a net buoyancy of the modular protective structure between a first net buoyancy at the raised position of the modular protective structure and a second net buoyancy less than the first net buoyancy at a submerged position of the modular protective structure where the modular protective structure is sufficiently submerged to protect the modular protective structure from the forces of ice features in the body of water.

3. The modular protective structure of claim 1, wherein the protective harbor wall includes a gate constructed and arranged to facilitate entry and exit of the offshore vessel into and out of the established harbor.

4. The modular protective structure of claim 1, wherein the modular protective structure further comprises an anchorage system constructed and arranged to retain the modular protective structure at a desired depth and/or location.

5. The modular protective structure of claim 1, wherein the flotation support is a modular flotation support comprising a plurality of discrete flotation elements operatively coupled together to form the flotation support.

6. The modular protective structure of claim 5, wherein the plurality of discrete flotation elements of the modular flotation support comprise a plurality of discrete flotation caissons operatively coupled together to form an annulus.

7. The modular protective structure of claim 1, wherein the protective harbor wall includes a sloped outer wall portion in an orientation to break ice features by directing portions of the ice contacted by the sloped outer wall portion downwardly.

8. The modular protective structure of claim 1, wherein an upper, outer edge portion of the annulus of the flotation support supports the protective harbor wall in an axisymmetrical relation.

9. The modular protective structure of claim 8, wherein a remaining upper portion of the annulus of the flotation support extends radially within the protective harbor wall and is constructed and arranged to receive end portions of extendible legs of a jackup as the offshore vessel.

10. The modular protective structure of claim 1, wherein the protective harbor wall is constructed and arranged to have a strength sufficient to withstand second-year ice conditions or other multi-year ice conditions such that the protective harbor wall provides a year round capacity to protect the offshore vessel within the harbor.

11. A method for extending the service of a floating offshore vessel in a geographical region having a season of ice conditions, comprising: establishing a harbor space protected from forces of ice features in a body of water at a location of operations by supporting a protective harbor wall with a flotation support to form a modular protective structure, the protective harbor wall constructed and arranged to enclose the harbor space, the harbor space being sized to receive the floating offshore vessel, the flotation support having a capacity to support the protective harbor wall in a raised position at the location of operations where the flotation support is in a floating condition below a surface of the body of water and where at least a portion of the protective harbor wall extends above the surface of the body of water; moving the offshore vessel into a position within the protective harbor wall at the location of operations; and extending operations of the offshore vessel in the season of ice conditions by maintaining the protective harbor wall in the raised position to protect the offshore vessel from ice features during the extended operations; wherein the protective harbor wall is a modular protective harbor wall comprising a plurality of discrete elements operatively coupled together to a form of the modular protective harbor wall which is open at the top and the bottom; and the plurality of discrete elements comprises a plurality of precast concrete panels, the plurality of precast concrete panels operatively coupled together using a wire wrapping circumferentially disposed around the plurality of precast concrete panels and a layer of shotcrete disposed over the wire wrapping.

12. The method of claim 11, further comprising retaining the modular protective structure at the location of operations with an anchorage system.

13. The method of claim 11, wherein the moving of the offshore vessel comprises:

submerging the modular protective structure at the location of operations;

moving the offshore vessel into a position proximate the location of operations; and raising the modular protective structure around the offshore vessel using the flotation support such that the offshore vessel is protected from forces of ice features in the body of water by the raised protective harbor wall.

14. The method of claim 11, wherein the flotation support is a modular flotation support comprising a plurality of discrete flotation elements operatively coupled together to form the flotation support.

* * * * *